US009878416B2

(12) United States Patent
Bahr

(10) Patent No.: US 9,878,416 B2
(45) Date of Patent: Jan. 30, 2018

(54) GRINDING MACHINE, PARTICULARLY COMPACT DESIGN CENTERLESS GRINDING MACHINE

(71) Applicant: Schaudt Mikrosa GmbH, Leipzig (DE)

(72) Inventor: Joerg Bahr, Borna (DE)

(73) Assignee: SCHAUDT MIKROSA GMBH (DE)

( * ) Notice: Subject to any disclaimer, the term of this patent is extended or adjusted under 35 U.S.C. 154(b) by 306 days.

(21) Appl. No.: 14/883,576

(22) Filed: Oct. 14, 2015

(65) Prior Publication Data

US 2016/0107285 A1 Apr. 21, 2016

(30) Foreign Application Priority Data

Oct. 17, 2014 (DE) ..... 10-2014-115149

(51) Int. Cl.
*B24B 5/18* (2006.01)
*B24B 41/02* (2006.01)
(Continued)

(52) U.S. Cl.
CPC ..... *B24B 5/18* (2013.01); *B24B 41/02* (2013.01); *B24B 41/04* (2013.01); *B24B 53/04* (2013.01)

(58) Field of Classification Search
CPC ..... B24B 5/18; B24B 41/02
(Continued)

(56) References Cited

U.S. PATENT DOCUMENTS 2,219,425 A * 10/1940 Lott ..... B24B 5/04 451/184
4,570,387 A * 2/1986 Unno ..... B24B 5/22 125/11.01

(Continued)

FOREIGN PATENT DOCUMENTS

DE 695 10 910 T2 1/2000
DE 298 25 161 U1 10/2005

(Continued)

*Primary Examiner* — Robert Rose
(74) *Attorney, Agent, or Firm* — Lewis Roca Rothgerber Christie LLP

(57) ABSTRACT

The present disclosure relates to a grinding machine, comprising a machine bed, a grinding spindle, that is arranged to be coupled with a spindle drive and for receiving a grinding wheel, a regulator spindle that is arranged to be coupled with a spindle drive and for receiving a regulator wheel, a workpiece mount for receiving a to-be-machined workpiece between the grinding spindle and the regulator spindle, wherein the grinding spindle and the regulator spindle are coupled with the machine bed and arranged in a fashion movable to one another, wherein the grinding spindle and the regulator spindle form a spindle set, wherein a longitudinal guide is formed at the machine bed, wherein a base carriage is received at the longitudinal guide, wherein the machine bed and the base carriage define a first movement axis, wherein the grinding spindle is coupled with the base carriage and assigned to a second movement axis, wherein the regulator spindle is coupled with the base carriage and assigned to a third movement axis, and wherein the grinding spindle and the regulator spindle are arranged to be moved with respect to one another, and to approach the workpiece mount in an in-feed movement.

20 Claims, 8 Drawing Sheets

(51) Int. Cl.
*B24B 41/04* (2006.01)
*B24B 53/04* (2012.01)

(58) Field of Classification Search
USPC ..... 451/49, 242, 5, 8–10
See application file for complete search history.

(56) References Cited

U.S. PATENT DOCUMENTS

| | | | | |
|---|---|---|---|---|
| 5,558,567 | A | 9/1996 | Hedberg | |
| 5,766,057 | A * | 6/1998 | Maack | B24B 5/35 451/194 |
| 6,312,318 | B1 * | 11/2001 | Mushardt | B24B 5/24 451/177 |
| 7,997,954 | B2 * | 8/2011 | Kobayashi | B24B 5/18 451/11 |

FOREIGN PATENT DOCUMENTS

| | | |
|---|---|---|
| DE | 60 2004 008 351 T2 | 5/2008 |
| DE | 10 2011 117 819 A1 | 5/2013 |

* cited by examiner

GRINDING MACHINE, PARTICULARLY COMPACT DESIGN CENTERLESS GRINDING MACHINE

CROSS-REFERENCE TO RELATED APPLICATION(S)

This application claims priority from German patent application 10 2014 115 149.6, filed on Oct. 17, 2014. The entire content of that priority application is fully incorporated by reference herewith.

BACKGROUND

The present disclosure relates to a grinding machine, for instance to a compact design centerless grinding machine, comprising a machine bed, a grinding spindle which is arranged to be coupled with spindle drive and for receiving a grinding wheel, a regulator spindle which is arranged to be coupled with a spindle drive and for receiving a regulator wheel, and a workpiece mount for receiving a to-be-machined workpiece between the grinding spindle and the regulator spindle. Grinding machines of that kind may be generally used for plunge grinding and/or for through-feed grinding.

The present disclosure generally relates to machine concepts for compact design centerless grinding machines. As used herein, this relates for instance to grinding machines that may be implemented with a reasonable installation space, for instance such machines that may be implemented at a base area which amounts to no more than 1.5 m×1.5 m (meter), preferably to no more than 1.25 m×1.25 m. The mentioned base areas may for instance involve base areas of a housing and/or a casing of the grinding machine. It goes without saying that for instance attachment parts and a space required for access openings, handling devices, service and maintenance openings and such like may basically cause a necessary of a larger base area. Nevertheless, the aforementioned measures make clear that, within the scope of this disclosure, compact design grinding machines shall be referred to as grinding machines requiring an installation space which is at least about 20%, preferably at least about 40%, further preferred at least about 50% less than the required (installation) space of conventional grinding machines which are implemented in "standard sizes".

Several concepts for designing centerless grinding machines, particularly centerless cylindrical grinding machines, are known from DE 10 2011 117 819 A1. This document relates to devices for dressing the grinding wheel and the regulator wheel of a centerless cylindrical grinding machine, wherein the dressing tool is movable in a defined fashion displaceable relative to the grinding wheel and the regulator wheel, respectively.

Grinding machines for machining workpieces are generally known in the art. Also centerless grinding machines as such are known in the art, for instance centerless cylindrical grinding machines. Centerless cylindrical grinding machines may be for in-stance arranged as external cylindrical grinding machines or internal cylindrical grinding machines. Generally, centerless grinding machines may be utilized for machining round, cylindrical workpieces, including rotationally symmetric workpieces. Centerless grinding machines may be used for plunge grinding or for through-feed grinding, for instance.

Centerless grinding machines are generally suited for series production and for mass production. Centerless grinding machines typically comprise a grinding wheel and a regulating wheel, wherein both the grinding wheel and the regulating wheel may be driven for rotation. The grinding wheel and the regulating wheel are generally arranged in a fashion parallel to one another and arranged to receive a to-be-machined workpiece therebetween. Generally, the grinding wheel comprises an abrasive material or is coated with an abrasive material. Generally, an abrasive material may be referred to as a material that is abrasively effective. The regulating wheel may comprise rubber material, rubber-like material and/or may be coated with rubber material and/or rubber-like material. In the alternative, the regulating wheel may comprise ceramic material and/or may be coated with ceramic material.

Generally, centerless grinding machines further comprise a workpiece mount which serves as a support for the workpiece. When the centerless grinding machine is operated for grinding, the workpiece may be thus contacted by the grinding wheel, by the regulating wheel, and by the workpiece mount. Regularly, the grinding wheel and the regulating wheel may be arranged in a fashion parallel to one another. It may be however also envisaged to arrange the grinding wheel at a small angular offset with respect to the regulating wheel. In this way, a feed movement for the workpiece may be generated.

Frequently, the grinding wheel comprises a greater diameter than the regulating wheel. The grinding wheel and the regulating wheel are generally provided with drives and/or may be coupled with drives. Generally, the grinding wheel and the regulating wheel are driven in the same direction of rotation, wherein, however, the respective drives are controlled in such a way that a circumferential velocity of the grinding wheel deviates from a circumferential velocity of the regulating wheel. As the workpiece is engaged, in the course of the grinding procedure, by the grinding wheel as well as by the regulating wheel which are generally operated at the same rotation direction, the workpiece is set in rotation due to the cooperation of the grinding wheel and the regulating wheel, wherein a direction of rotation is opposite to the direction of rotation of the grinding wheel and the regulating wheel, respectively. Due to the different circumferential velocities of the grinding wheel and the regulating wheel, a relative motion between the workpiece and the grinding wheel may be generated which may comprise slippage or spin. In this way, material may be removed from the workpiece.

In view of this, it is a first object of the present disclosure to present a grinding machine, for instance a compact design centerless grinding machine, which may be implemented with a limited, considerably small installation space.

It is a further object of the present disclosure to present a grinding machine which may provide comprehensive functional performance.

It is a further object of the present disclosure to present a grinding machine which is further arranged for machining non-cylindrical workpieces, such as conical workpieces, workpieces comprising plunges, grooves, shoulders, and such like.

It is a further object of the present disclosure to present a grinding machine which may be manufactured and implemented with little effort, and which may be operated at low cost.

It is a further object of the present disclosure to present a grinding machine which comprises a considerable robustness, wherein maintenance work and/or repair work, if required, may be performed with little effort.

SUMMARY

These and other objects of the present disclosure are achieved by a grinding machine, for instance a compact design centerless grinding machine, comprising a machine bed, a grinding spindle, that is arranged to be coupled with a spindle drive and for receiving a grinding wheel, a regulator spindle that is arranged to be coupled with a spindle drive and for receiving a regulator wheel, a workpiece mount for receiving a to-be-machined workpiece between the grinding spindle and the regulator spindle, wherein the grinding spindle and the regulator spindle are coupled with the machine bed and arranged fashion movable to one another, wherein the grinding spindle and the regulator spindle form a spindle set, wherein a longitudinal guide is formed at the machine bed, wherein a base carriage is received at the longitudinal guide, wherein the machine bed and the base carriage define a first movement axis, wherein the grinding spindle is coupled with the base carriage and assigned to a second movement axis, wherein the regulator spindle is coupled with the base carriage and assigned to a third movement axis, and wherein the grinding spindle and the regulator spindle are movable with respect to one another and arranged to approach the workpiece mount in an in-feed movement.

In accordance with the disclosure, a considerably compact and space-saving design is achieved by providing the whole functionality of the grinding machine even though basically only three movement axes for the essential components of the grinding machine are provided. The term movement axis shall be understood, within the scope of this disclosure, in its common meaning in the field of machine tools. Accordingly, a movement axis may for instance involve a linear movement axis which enables a linear displacement movement between two components of the grinding machine. Further, the movement axis may involve a rotary movement axis or pivot axis which enables a relative rotational movement or swiveling movement between two components of the grinding machine. Thus, generally in total six movement axes may be envisaged in a three-dimensional space, provided that for instance a Cartesian coordinate system is taken as a basis. Among the afore-mentioned six movement axes, three axes may basically relate to linear movement, for instance along an X-axis, a Y-axis and a Z-axis. Further, three movement axes in the form of so-called pivot axes may be provided, which for instance relate to rotational movements or swiveling movements about the X-axis, about the Y-axis and about the Z-axis. In accordance with a common nomenclature, accordingly, the rotational axes or pivot axes may be arranged as an A-axis, a B-axis and a C-axis.

It goes without saying that the above configuration, at least in some embodiments, does not necessarily has to exclude that, as the case may be, further auxiliary axes are provided. These auxiliary axes, however, primarily may not be used for in-feed or approaching movements within the scope of the workpiece machining as such and/or the dressing of the grinding wheel and/or the regulator wheel as such. For instance, a conceivable auxiliary axis for a defined inclination of the regulator spindle about the X-axis is referred to. Such an axis may also be referred to as A-axis and may refer to a swiveling movement about the X-axis. By means of an A-axis movement of the regulator spindle, a deliberate inclination may be achieved, which may effect a workpiece feed, for instance when through-feed grinding. Further, also when plunge grinding an at least minimum inclination by inclining the regulator spindle about the X-axis may be desired so as to (axially) receive the workpiece in a defined fashion. This may further increase the accuracy and reproducibility.

In accordance with the above embodiment it is suggested to provide the grinding machine with only three movement axes for the essential components thereof. For instance, three movement axes may be selected from the elucidated "pool" of movement axes. If for instance the grinding spindle and the regulator spindle of the grinding machine are involved, which, however, may be basically coupled with one another but arranged in a fashion movable with respect to one another, it would be even conceivable to implement two of the above-indicated three movement axes as basically parallel or coincident movement axes. This may involve the effect that for instance guide elements and such like may be used by both parallel and coincident movement axes. This may further reduce the required effort for implementing the grinding machine.

Insofar as it is mentioned within the scope of this disclosure that for instance a first component is arranged to be coupled or is coupled with a second component, this may involve both the case that both components are directly coupled with one another or arranged to be coupled with one another, and also the case that both components are mediately coupled with one another or arranged to be coupled with one another. A mediate coupling may be for instance present when further components are interposed between the first component and the second component. However, insofar as it is explicitly mentioned within the scope of this disclosure that a first component is directly coupled with a second component or arranged at the second component, it may be assumed that no further component is arranged between or interposed between the first component and the second component.

In accordance with the common nomenclature for machine tools, for instance for grinding machines, the longitudinal guide may be arranged as a so-called Z-guide which enables a movement in the longitudinal direction Z-direction. Generally, the longitudinal direction or Z-direction is orientated in a fashion parallel to a longitudinal axis of the to-be-machined workpiece and/or to a workpiece holder or mount which is arranged for receiving the workpiece.

Further, generally a transverse direction or X-direction is defined which is perpendicular to the longitudinal direction and which jointly spans as a plane with the longitudinal direction, wherein the plane may be basically oriented in a fashion parallel to a mounting surface of the machine bed. Further, a so-called vertical direction or Y-direction may be provided which may basically represent a height extension.

Insofar as an in-feed (approaching) movement is mentioned within the scope of this disclosure, this generally shall be understood as a movement of the grinding spindle and/or the regulator spindle which may basically take place in the transverse direction, that is, basically perpendicular to the longitudinal direction. It goes without saying that basically also movements may be envisaged which are not accomplished in a fashion ideally parallel to the transverse direction and/or perpendicular to the longitudinal direction. This may be the case when a deliberate inclination of the grinding wheel and/or the regulator wheel with respect to the longitudinal axis of the to-be-machined workpiece is induced so as to provide a workpiece feed, for instance. As used herein within the scope of this disclosure, a feed movement shall be generally understood as a movement basically parallel to the longitudinal direction and basically perpendicular to the transverse direction. The feed movement may be for instance effected by the workpiece itself relative to spindle set, when through-feed grinding. For this purpose, it may be envisaged to incline the regulator spindle in a defined fashion about a transverse axis so as to generate a force component that is effective in the feed direction when engaging the workpiece. The respective movement axis may be also referred to as A-axis, which represents the swiveling movements about said transverse axis.

In an exemplary embodiment, both the grinding spindle and also the regulator spindle are mediately coupled with the machine bed of the grinding machine via the base carriage. Hence, both the grinding spindle and also the regulator spindle may be jointly moved, when moving the base carriage in the longitudinal direction, by a respective amount in the longitudinal direction. The spindle set which is formed by the grinding spindle and the regulator spindle may be regarded as a logical unit. In other words, the term spindle set shall be primarily used as a designation of the group which is formed by the grinding spindle and the regulator spindle. It is not required in this respect that the grinding spindle and the regulator spindle have to form a structural unit.

The above-indicated configuration of the grinding machine may have the structural effect that for instance no separate B-axis (movement axis for swiveling movements about the Y-axis) is required so as to effect for instance a defined inclination between the grinding spindle and the workpiece mount and/or the regulator spindle and the workpiece mount. By means of such B-axes one of which generally has to be provided for each of the grinding spindle and the regulator spindle, on the one hand, these inclinations may be effected in a simple and flexible fashion and may be adjusted when the grinding machine is operated. This may increase the flexibility and productivity of a conventional grinding machine. However, at the same time, the structural effort for such an arrangement which thus requires further respective movement axes becomes considerably larger.

The present disclosure therefore makes profit of the fact that workpieces whose shape considerably deviates from a pure cylinder shape may be machined, in the alternative, when the grinding wheel and/or the regulator wheel are arranged in a respective "mirror-symmetric" fashion with respect to the workpiece. In accordance with the above described basic concept it is at least enabled that the grinding spindle and the regulator spindle may be "freely" displaced such that the grinding wheel which is received at the grinding spindle and/or the regulator wheel which is received at the regulator spindle may be brought into engagement with respective dressing tools to adapt the contour thereof to the desired shape of the to-be-machined workpiece. In other words, at least one dressing unit comprising a dressing tool may be provided. The dressing unit is, in an exemplary embodiment, fixedly coupled with the machine bed in such a way that, using only three movement axes, an adaption of the grinding wheel and/or the regulator wheel may be effected so as to enable the machining of non-cylindrical workpieces. In an exemplary embodiment, each of the grinding wheel and the regulator wheel, as such, may approach the dressing tool assigned the respective wheel in a desired fashion, using only two axes of the three axes, and may receive its desired contour by a cutting engagement.

The above-elucidated basic principle of a compact design centerless grinding machine comprising only three movement axes for the main components of the grinding machine enables a plurality of variations which may form the subject-matter of preferred embodiments.

As used herein, the term in-feed movement shall generally refer to an approaching movement of the grinding wheel of the regulator wheel with respect to the workpiece, wherein a main direction of the approaching movement is perpendicular or at least basically perpendicular to the longitudinal axis of the workpiece. Further, as used herein, the term feed movement shall be referred to as a relative movement of the workpiece with respect to the grinding wheel and/or the regulator wheel, wherein the main direction of the feed movement is parallel to or aligned with the longitudinal axis of the workpiece.

According to a preferred embodiment, the first spindle of the spindle set is coupled with the base carriage via a primary guide unit which defines the second movement axis, wherein the second spindle of the spindle set is coupled with the base carriage via a secondary guide unit which defines the second movement axis, wherein at least one of the primary guide unit and of the secondary guide unit is arranged as a swivel guide or a linear guide.

In an exemplary embodiment, the primary guide unit and the secondary guide unit at least sectionally use the same guide elements. It is further preferred when the primary guide unit and the secondary guide unit define parallel movement axes or even at least sectionally coincident movement axes.

According to a further embodiment, the primary guide unit is directly coupled with the base carriage. According to a further alternative, also the secondary guide unit is directly coupled with the base carriage. In this way, both the primary guide unit and also the secondary guide unit may utilize common guide elements which are provided at the base carriage. According to an alternative embodiment, the primary guide unit is directly coupled with the base carriage, wherein the secondary guide unit is directly coupled with the primary guide unit. In accordance with this embodiment, the primary guide unit may be interposed between the base carriage and the secondary guide unit.

According to a further embodiment, a movement of the primary guide unit relative to the base carriage effects a corresponding movement of the secondary guide unit relative to the base carriage. This applies for instance when the primary guide unit is directly coupled with the secondary guide unit and arranged between the secondary guide unit and the base carriage.

According to an alternative embodiment, the primary guide unit and the secondary guide unit are movable relative to the base carriage in a fashion independent of one another. In other words, the primary guide unit and the secondary guide unit may, on the one hand, at least sectionally utilize the same guide elements which are provided at the base carriage. However, further separate drive means may be provided which enable a movement of both guide units independently from one another.

According to a further embodiment of the grinding machine, a transverse guide is formed at the base carriage, wherein a primary carriage and a secondary carriage is received at the transverse guide, wherein a first spindle of the spindle set is assigned to the primary carriage, and wherein a second spindle of the spindle set is assigned to the secondary carriage. In other words, the primary guide unit may be arranged as a primary carriage. Accordingly, the secondary guide unit may be arranged as a secondary carriage. The transverse guide may be also referred to as X-guide. For instance, the transverse guide is arranged as a linear guide. The transverse guide may be for instance oriented in a fashion basically perpendicular to the longitudinal guide. The primary carriage and the secondary carriage may be assigned to a common transverse guide that is formed at the base carriage. It is therefore not necessary to provide a separate transverse guide for each carriage.

The spindle set involves the grinding spindle and the regulator spindle. Hence, the first spindle may be one of both spindles, and the second spindle may be the other one of both spindles.

In an alternative embodiment of the grinding machine, at least one spindle of the spindle set is arranged at the base carriage in a pivotable fashion and arranged to approach the workpiece mount in an in-feed movement through a swiveling movement about a pivot axis. Also a swiveling movement about the longitudinal axis (Z-axis) may effect an in-feed movement in the transverse direction (X-direction), when the wheel which is assigned to the at least one spindle is arranged in a fashion eccentrically to the pivot axis. The pivot axis may be also referred to as C-axis. In accordance with this embodiment, at least one of the primary guide unit and the secondary guide unit is arranged as a swivel guide.

According to a further embodiment, the first spindle of the spindle set is arranged at the base carriage in a pivotable fashion and arranged to approach the workpiece in an in-feed movement through a swiveling movement about a pivot axis, wherein the second spindle of the spindle set is arranged at a transverse guide in a fashion displaceable along the transverse guide, wherein the second spindle is arranged to approach the workpiece mount in an in-feed movement. In other words, one guide unit may be arranged as linear guide unit and another guide unit may be arranged as a swivel guide unit.

According to a further embodiment, at least the base carriage, the primary guide unit or the secondary guide unit comprise an integrated displacement drive. In an exemplary embodiment, the integrated displacement drive is arranged as a structurally integrated displacement drive. This may for instance involve that a displacement motor is directly assigned to the base carriage, the primary guide unit or the secondary guide unit, respectively. In other words, no effortful means for force transmission are required, such as for instance belt drives, chain drives, hydraulic drives and such like. This may lead to a further simplification of the configuration of the grinding machine and may further reduce the required installation space.

An integrated displacement drive may be for instance referred to as a so-called "cantilever" or "flying" drive. This may involve, on the one hand, that sufficiently flexible lines have be provided to supply the drives which, as such, are basically movable with respect to the machine bed, with energy. By way of example, for instance a so-called cable carrier may be required. Conversely, however, no effortful mechanical force transmission via gears and such like between positionally fixed drives which are for instance fixed to the machine bed, and a to-be-moved unit, for instance the base carriage, the primary guide unit or the secondary guide unit are required.

According to a refinement of this embodiment, at least one integrated displacement drive is coupled with a threaded spindle, for instance a threaded spindle which is attached in a torque-proof fashion. Accordingly, the at least one integrated displacement drive may comprise a spindle nut or a similar component, which may be set into rotation by an appropriate motor to effect a relative movement. Hence, for instance an output rotation of a motor may be converted via the spindle nut into a longitudinal movement.

Insofar as the respective displacement drive is arranged as a pivot drive, the integrated drive may for instance involve a so-called high-torque motor.

According to a further alternative embodiment, at least one integrated displacement drive is arranged as a direct drive. The direct drives may be envisaged both for pivot drives and/or also for linear drives. Insofar as a linear drive is used, the direct drive may for instance involve a linear motor. It may be for instance envisaged to provide a respective linear motor for both the primary carriage and also for the secondary carriage which may be coupled with the same stator which may be for instance formed at the base carriage.

It goes without saying that a stator of a linear motor is generally an elongated element having a linear extension which cooperates with a (flat) "rotor". Put simply, a linear motor may be regarded as an "unwinding" of a motor with a rotatory output.

According to a further embodiment of the grinding machine, the workpiece mount is fixedly attached to the machine bed. This may have the effect that the workpiece mount may be implemented with little structural effort. It is not necessary to provide the workpiece mount with appropriate in-feed drives and/or feed drives. Required in-feed movements and/or feed movements may be effected by an appropriate cooperation of the base carriage with the primary guide unit and the secondary guide unit.

According to a further embodiment of the grinding machine, at least one dressing unit for receiving a dressing tool is provided, wherein the at least one dressing unit is configured for machining at least one of the grinding wheel and the regulator wheel, and wherein the at least one dressing unit is fixedly attached to the machine bed.

In an exemplary embodiment, the grinding machine is provided with a machine control which is operable to bring at least of the grinding wheel or the regulator wheel into engagement with the respectively assigned dressing tool in a controlled fashion so as to machine an exterior contour, for instance a circumference contour of the respective wheel in a defined fashion. In this way, non-cylindrical rotationally symmetric workpieces may be machined without the need of separate swiveling drives (B-axis drives) for swiveling the grinding spindle and/or the regulator spindle about the Y-axis. Further, necessary controls and/or regulators for such a B-axis may be dispensed with.

According to a refinement of this embodiment, the at least one dressing unit is arranged adjacent to the workpiece mount. This may have the effect that the dressing tool which is provided at the at least one dressing unit may be easily approached or reached. In this way, even though only limited process space is provided, which is generally involved with compact exterior dimensions of the grinding machine, a comprehensive functionality may be provided. The process space of the grinding machine may be for instance defined by maximum dimensions of to-be-machined workpieces and/or of grinding wheels and regulator wheel, respectively, which may be received.

According to a an exemplary embodiment, a grinding machine is provided, for instance a compact design centerless grinding machine, which comprises exactly one base carriage which is received at the machine bed and which is arranged for implementing a common feed movement of the grinding wheel and the regulator wheel, exactly one primary guide unit and exactly one secondary guide unit, which are arranged at the base carriage and which may comprise, in an exemplary embodiment, at least sectionally, common guide elements, wherein the primary guide unit is coupled with a first spindle of the spindle set for implementing an in-feed movement, and wherein the secondary guide unit is coupled with a second spindle of the spindle set for implementing an in-feed movement, wherein the base carriage, the primary guide unit and the secondary guide unit are arranged to displace the first spindle and the second spindle with respect to the workpiece mount and with respect to at least one dressing unit, wherein exactly three movement axes are provided, wherein the machine bed and the base carriage define a first movement axis along the longitudinal guide, wherein the primary guide unit defines the second movement axis, and wherein the secondary guide unit defines the third movement axis.

The above described embodiment may form part of a distinct embodiment which may form subject matter of an independent claim.

Insofar as it is mentioned within the present disclosure that "exactly" a number of elements is provided, or that a "single" element is provided, this shall be understood in a way that no further respective elements are provided.

A grinding machine which is arranged in accordance with at least some basic principles of this disclosure may be varied in different ways to form suitable variants.

In regard of axes concepts which may be envisaged for the utilized movement axes, it is essential that three movement axes are utilized. The movement axis which is formed between the machine bed and the base carriage is for instance arranged as a so-called Z-axis. A relative movement between the grinding spindle and the base carriage and/or between the regulator spindle and the base carriage may be effected via the primary guide unit and via the secondary guide unit. In accordance with one variant, the primary guide unit is arranged as X-axis, wherein also the secondary guide unit is arranged as so-called X-axis. Departing from this variant, it may be envisaged, on the one hand, that the primary guide unit and the secondary guide unit, at least sectionally, utilize common guide elements. It may be, however, also envisaged that the X-axes which are defined by the primary guide unit and the secondary guide unit are arranged in a fashion offset from one another and parallel to one another.

According to a further embodiment, at least one of the primary guide unit and the secondary guide unit, instead of being arranged as a linear guide and/or linear axis, may be arranged as a swivel guide and/or a pivot axis, for instance as so-called C-axis, which enables a swiveling movement or rotational movement about the Z-axis.

Insofar as both the primary guide unit and also the secondary guide unit respectively define an X-axis, it may be envisaged, on the one hand, that the X-axes are arranged in a symmetric fashion. However, also an asymmetric configuration of the X-axes may be envisaged.

The at least one dressing unit is, in an exemplary embodiment, fixedly coupled with the machine bed, i.e. not movable with respect to the machine bed. The at least one dressing unit may be arranged in proximity to the workpiece mount. It may be envisaged, however, that the at least one dressing unit is arranged at the machine bed in a fashion spaced away from the workpiece mount.

The at least one dressing unit, on the one hand, may be directly arranged at the machine bed. However, it may be also envisaged to provide the at least one dressing unit at a bridge (portal) or a support arm which is fixedly coupled with the machine bed. In the same way, also the arrangement of the workpiece mount may be varied.

Also with respect to the at least one displacement drive, different variants may be envisaged. In an exemplary embodiment, at least one of the displacement drives of the base carriage, the primary guide unit and the secondary guide unit is arranged as a linear drive which comprises at least one threaded spindle and a nut which is arranged to be coupled with the threaded spindle. Either the threaded spindle or the nut may be arranged in a torque-proof fashion. The other element of the threaded spindle and the nut may be respectively arranged in a rotational drivable fashion so as to effect a linear movement.

In an exemplary embodiment, when the primary guide unit is arranged as a primary carriage and the secondary guide unit is arranged as a secondary carriage, both carriages may be assigned with displacement drives which use a common threaded spindle. Each of the displacement drives of the primary carriage and the secondary carriage may thus comprise a rotatable nut so as to displace the primary carriage or the secondary carriage along the threaded spindle.

Further configurations may be envisaged wherein drives of the respective displacement drives are not directly arranged at the to-be-moved element, i.e. for instance at the base carriage, the primary carriage and/or the secondary carriage. Accordingly, in the view of the to-be-moved element, the motor may be "fixedly" arranged and, for instance, drive a threaded spindle in a rotational fashion, wherein the threaded spindle cooperates with a nut which is fixedly coupled with the respective carriage so as to effect the displacement movement. As already described above, at least one linear motor may be provided instead of at least one threaded spindle drive.

Both the at least one displacement drive for the X-axis and/or the X-axes and the displacement drive for the Z-axis may be basically implemented as a threaded spindle drive, a linear motor or in a similar fashion. Insofar as a threaded spindle drive is provided, it may be envisaged, on the one hand, to power or drive the threaded spindle as such. On the other hand, it may be envisaged, to drive a nut which is coupled with the threaded spindle, wherein in the latter case the threaded spindle is arranged in a torque-proof fashion.

Each of the above-mentioned variants may be basically combined with one another. When a grinding machine is implemented in accordance with the aspects and variants of this disclosure, a machine may be implemented with limited installation space and at reasonable efforts which provides a broad operational scope and, despite of the compact simple design, enables a multitude of applications.

A grinding machine which is arranged in line with this in a compact design fashion is for instance suited for small series manufacturing and/or middle series manufacturing. It goes without saying that for instance in mass production generally single-purpose or specifically adapted multi-purpose machines are utilized which typically require considerably larger installation space and base areas.

It is to be understood that the previously mentioned features and the features mentioned in the following may not only be used in a certain combination, but also in other combinations or as isolated features without leaving the spirit and scope of the present disclosure.

BRIEF DESCRIPTION OF THE DRAWINGS

Further features and exemplary embodiments are disclosed in the description below with reference to the drawings, in which.

DETAILED DESCRIPTION

Figure 1:
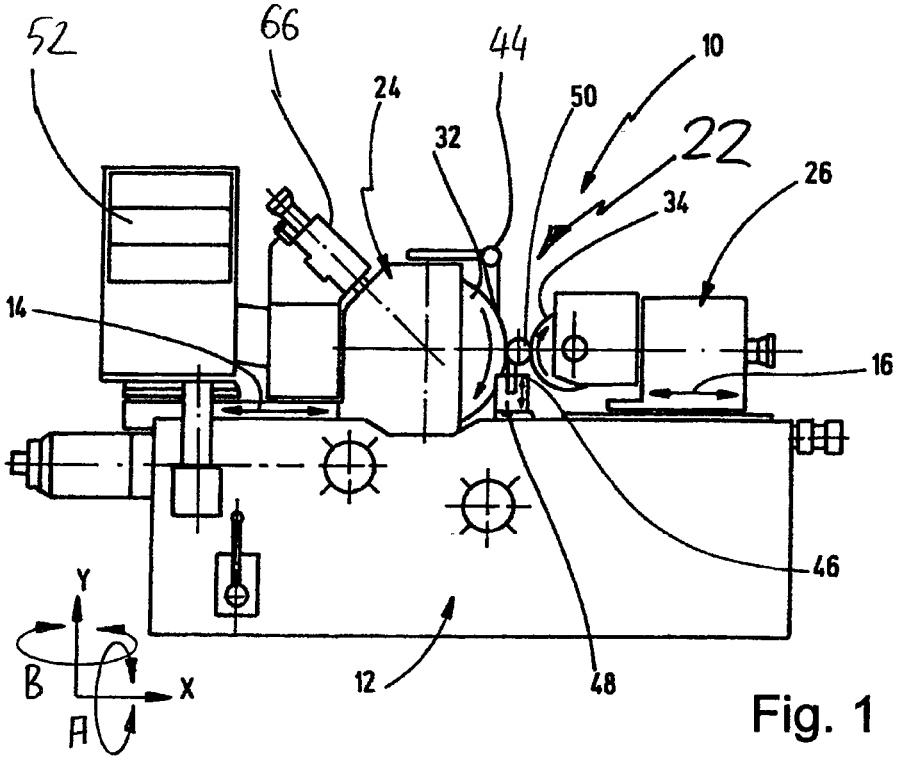
FIG. 1 is a schematic frontal view of a grinding machine, which is arranged as a centerless grinding machine.

FIG. 1 illustrates a frontal view of a grinding machine which is designated by 10. With reference to FIG. 1 and with further reference to FIG. 2 which shows a schematic, greatly simplified partial view of a grinding machine 10 in top view, a basic structure and basic components of the grinding machine 10 will be described in the following.

Figure 2:
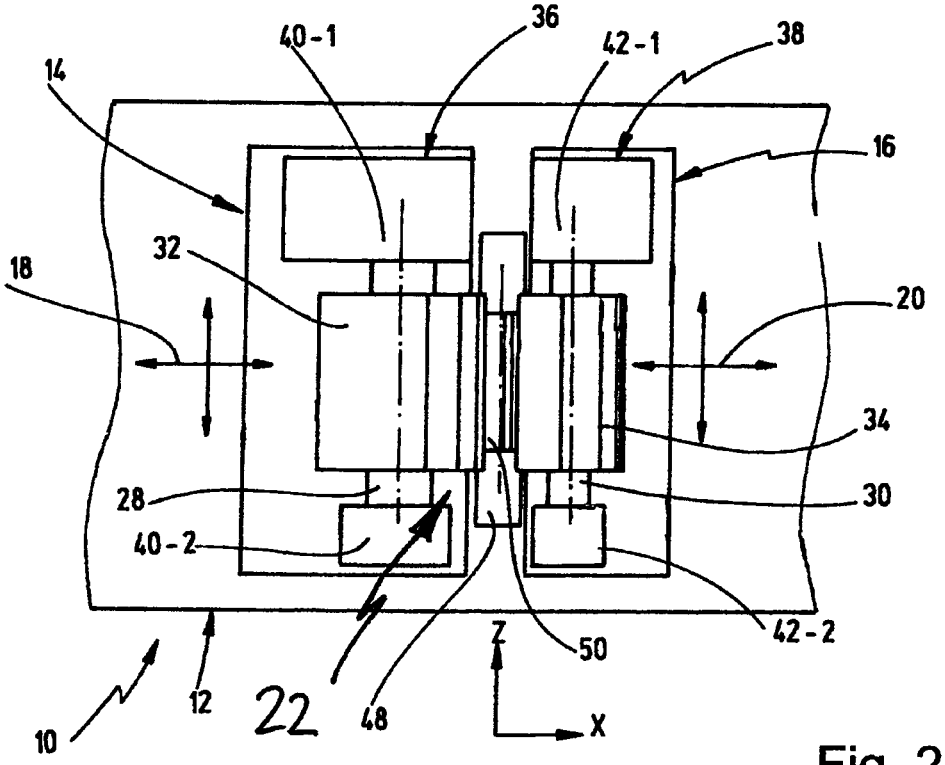
FIG. 2 is a greatly simplified schematic partial view of a centerless grinding machine in top view.

The grinding machine 10 may be for instance arranged as a so-called centerless grinding machine 10. By way of example, the grinding machines which are illustrated by means of FIGS. 1 and 2 are arranged as centerless external cylindrical grinding machines. The grinding machine 10 comprises a machine bed 12 which may be also referred to as frame. At the machine bed 12, saddle slideways 14, 16 may be received which enable displacement movements of components of the grinding machine 10.

A coordinate system X-Y-Z may be inferred from FIGS. 1 and 2 which may be utilized to designate main directions and main axes, respectively, of the grinding machine 10. Regularly, an axis that for instance coincides with a longitudinal axis of a workpiece which is received at the grinding machine 10, or which is at least substantially parallel to this axis is regularly designated by Z. The axis Z is further oriented in substantially parallel fashion to at least one spindle axis of the grinding machine 10. An axis which may for instance serve as an in-feed axis is regularly designated by X. Generally, the axis X is oriented in a perpendicular fashion with respect to the axis Z. Generally, the axis X is referred to as working axis. An axis Y generally designates a height extension. The axis Y is typically arranged in perpendicular fashion to the axis X and in perpendicular fashion to the axis Z.

The saddle slideways 14, 16 may be arranged as translational guides and may for instance enable in-feed movements along the X-axis. The saddle slideways 14, 16 may be however also arranged as cross table saddle slideways. Accordingly, the saddle slideways 14, 16 may enable, in addition to the movement along the X-axis, also a movement along the Z-axis. The Z-axis may be also referred to as feed axis. Movement directions which may be envisaged and which are enabled by the saddle slideway 14, 16 are indicated in FIG. 2 by arrows designated by 18, 20.

The grinding machine 10 may further comprise a grinding headstock 24 and a regulating wheel headstock 26. At the grinding headstock 24, a grinding spindle 28 may be received in a rotatable fashion. At the regulating wheel headstock 26, a regulator spindle 30 may be received in a rotatable fashion. The grinding spindle 28 may be configured for carrying at least one grinding wheel 32. The regulator spindle 30 may be configured for carrying at least one regulating wheel 34. The grinding headstock 24 may be further provided with a grinding wheel drive 36, or at least coupled with a respective grinding wheel drive 36. The regulating wheel headstock 26 may be provided with a regulating wheel drive 38, or at least coupled with a regulating wheel drive 38. The saddle slideway 14 is assigned to the grinding headstock 24. The saddle slideway 16 is assigned to the regulating wheel headstock 26. The saddle slideways 14, 16 may be coupled with suitable drives to enable translational movements of the grinding headstock 24 and/or the regulating wheel headstock 26 in a X-Z plane, refer to the arrows designated by 18, 20 in FIG. 2.

The grinding wheel drive 36 may comprise at least one motor, for instance an electromotor. The regulating wheel drive 38 may comprise at least one motor, for instance an electromotor. The grinding wheel drive 36 may be coupled with the grinding spindle 28 in a direct or mediate fashion. A mediate coupling may be for instance achieved by a gear, a clutch and similar elements. The regulating wheel drive 38 may be coupled to the regulator spindle 30 in a direct or mediate fashion. A mediate coupling may be achieved by a gear, a clutch or similar elements interposed therebetween.

The grinding spindle 28 may comprise at least one bearing 40, optionally two bearing locations 40-1, 40-2 between which the grinding wheel 32 is arranged, refer to FIG. 2. The regulator spindle 30 may comprise at least one bearing 42, optionally a first bearing location 42-1 and a second bearing location 42-2. Between the bearing locations 42-1, 42-2, the at least one regulating wheel 34 may be arranged, refer also to FIG. 2.

Between the grinding spindle 28 and the regulator spindle 30, a workpiece mount 46 is arranged which is received at a workpiece mount support 48. The workpiece mount 46 is configured for receiving and/or supporting a workpiece 50 which can be received between the grinding spindle 28 and the regulator spindle 30 for grinding machining. The workpiece mount 46 may be also referred to as support ruler.

The grinding spindle 28 including the grinding wheel 42 which is attached thereto is rotatable and/or drivable in a rotary fashion about a longitudinal axis. The regulator spindle 30 including the regulating wheel 34 which is attached thereto is rotatable and/or drivable in a rotary fashion about a longitudinal axis. The grinding spindle 28 and the regulator spindle 30 may cooperate in such a way that the workpiece 50 which is received therebetween may be set in rotation about its longitudinal axis by the grinding wheel 32 and the regulating wheel 34. In other words, the workpiece 50 may be driven by the grinding wheel 32 and the regulating wheel 34 in a mediate fashion. As can be inferred from FIGS. 1 and 2 in conjunction, the longitudinal axes may be arranged in a common X-Z plane. In an exemplary embodiment, the longitudinal axes may be arranged with respect to one another in a parallel fashion. As already mentioned herein before, it may be also envisaged that at least the regulator spindle 30 and/or the longitudinal axis thereof may be at least slightly inclined with respect to the longitudinal axis of the grinding spindle 28, and/or may be pivoted about the transverse axis. Such an inclination may cause a feed motion of the workpiece 50. This may be an option, for instance, for so-called through feed grinding operations. In this way, for instance a feed motion of the workpiece may be provided. It goes without saying that a feed motion of the workpiece 50 may be also achieved in a different way. Generally, the grinding machine 10 may be also configured for performing groove grinding or plunge grinding operations.

Based on the view of FIG. 1, it is further apparent that the grinding wheel 32 and the regulating wheel 34 may be basically drivable in a rotatory fashion in the same direction of rotation. Generally, a rotatory drive of the grinding wheel 32 and the regulating wheel 34 is effected in such a way that different circumferential velocities may be present at the same. A resulting circumferential velocity difference may effect an entrainment of the workpiece 50 by the grinding wheel 32 and the regulating wheel 34 which comprises slippage or spin. Basically, the workpiece 50 is set in rotation by the grinding wheel 32 and the regulating wheel 34, the direction of rotation of which is opposite is to the direction of rotation of the grinding wheel 32 and of the regulating wheel 34. Based on the different levels of circumferential velocities of the grinding wheel 32 and the regulating wheel 34, basically no "ideal" slippage-free or spin-free entrainment may be effected. Rather, between the workpiece 50 and the grinding wheel 32, a relative movement, for instance a sliding relative movement, may be effected. This relative movement basically causes the material removal at the workpiece 50.

By appropriately controlling carriage drives (not separately shown in FIGS. 1 and 2) of at least one of the grinding headstock 24 and the regulating wheel headstock 26, further an in-feed force and/or pressing-on force in the X-direction to the workpiece 50 may be defined and generated. In other words, the workpiece 50 may be clamped between the grinding wheel 32 and the regulating wheel 34, for instance clamped in a biased state.

By way of example, the grinding machine 10 may further comprise a feed 44 for a coolant and lubricant cutting fluid (abbreviation: KSS-feed). Further, in an exemplary embodiment the grinding headstock 24 may be associated with a dressing device 66 for dressing the grinding wheel 32. The grinding machine 10 may be provided with a control device 52 by means of which an operator may operate and run the grinding machine 10. It goes without saying that the control device 52 may be also arranged for an automatic control of the grinding machine 10.

In the following, with reference to FIGS. 3 to 15, different embodiments and concepts, respectively of grinding machines 10 which are arranged in accordance with at least some principles of the present disclosure will be elucidated. In exemplary embodiments, the grinding machines 10 are arranged as respective centerless grinding machines. In exemplary embodiments, the grinding machines 10 are further distinguish themselves by their considerably compact design, which benefits from the respective machine concept.

Insofar as elements, components and/or sub-assemblies are designated by the same reference numerals in the context of this disclosure, is shall be understood that these items are of the same kind—at least with respect to their concept. Nevertheless, it goes without saying that design modifications of the elements, components and/or modifications of the elements, components and/or sub-assemblies may be envisaged. However, generally this will be separately elucidated.

According to the embodiments illustrated with reference to FIGS. 3 to 15, both the grinding wheel 32 and also the regulator wheel 34 may be mounted in a cantilever fashion. It goes without saying that basically also a configuration in accordance with FIG. 2 may be envisaged, wherein at least one of the grinding wheel 32 and regulator wheel 34 is arranged between two bearing locations 40, 42.

Figure 3:
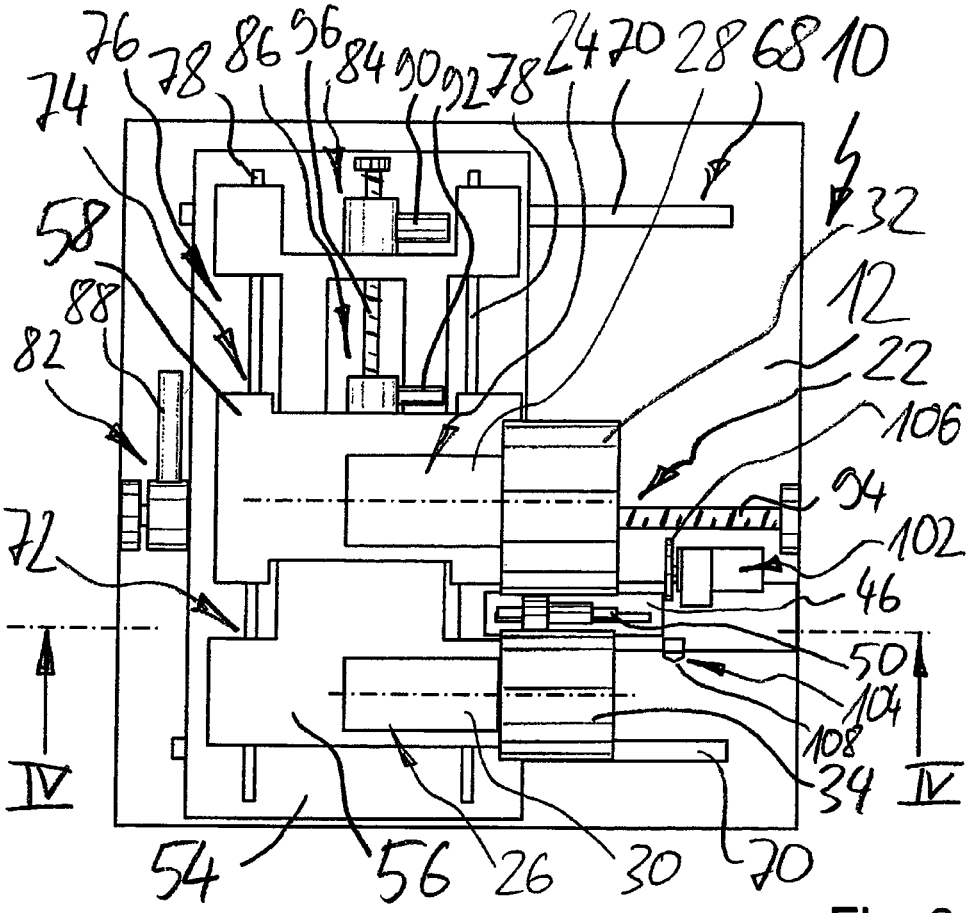
FIG. 3 is a greatly simplified schematic top view of an embodiment of a centerless grinding machine comprising three movement axes in a first configuration.
Figure 4:
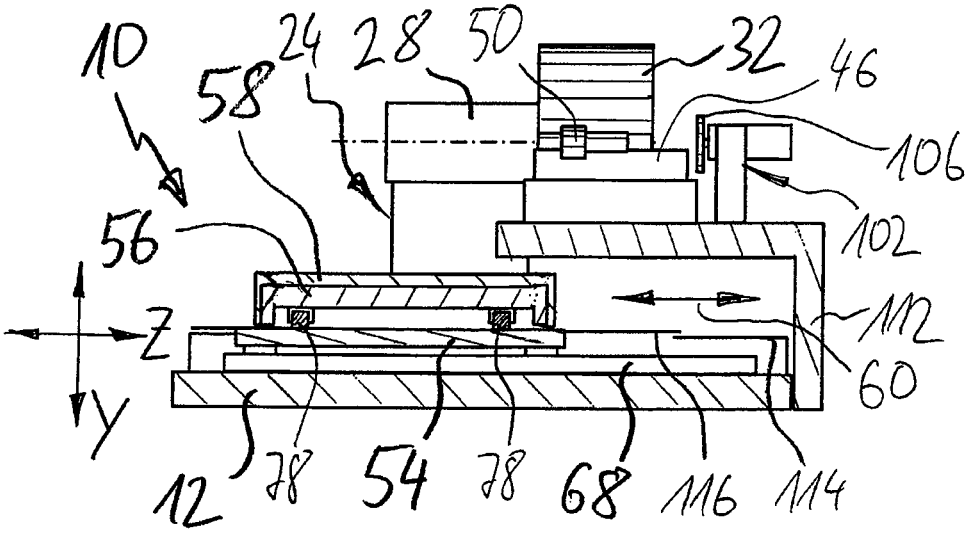
FIG. 4 is a greatly simplified schematic cross-sectional view of a grinding machine which is at least similar to the configuration of FIG. 3, along the line IV-IV in FIG. 3.
Figure 5:
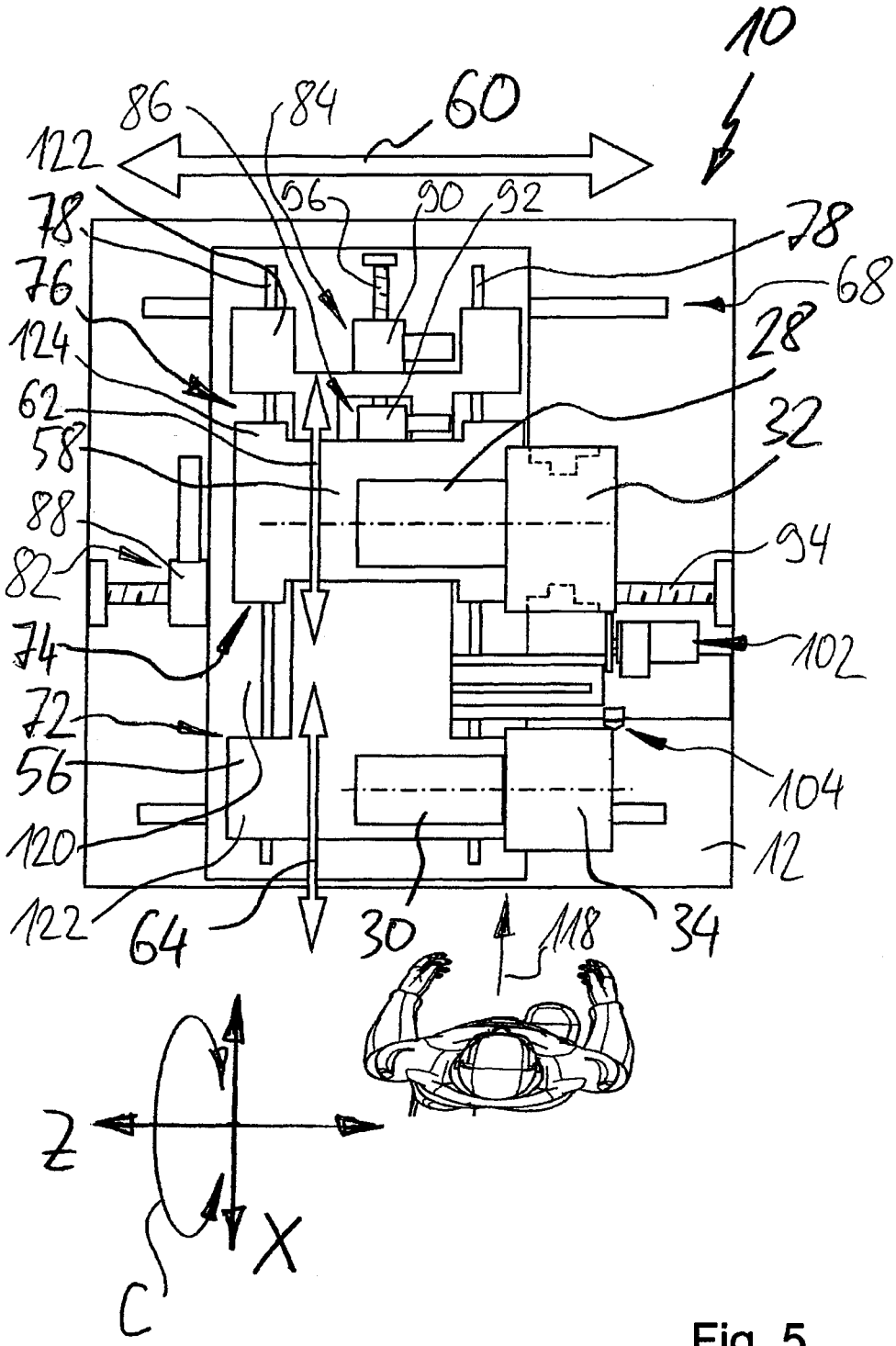
FIG. 5 is a further greatly simplified schematic top view of the grinding machine of FIG. 3 in a state which deviates from the view of FIG. 3.

With particular reference to FIGS. 3 to 5, a first embodiment of a grinding machine 10 is elucidated and described in more detail. FIG. 3 and FIG. 5 each show respective schematically greatly simplified top views of the grinding machine 10, wherein movable components of the grinding machine 10 in FIGS. 3 and 5 assume different relative positions. FIG. 4 shows a lateral cross-sectional view of the grinding machine 10 along the line IV-IV in FIG. 3. Also the illustration of FIG. 4 is greatly simplified and of a schematic kind. This means that FIG. 4 does not necessarily have to be an entirely correct cross-sectional representation of the embodiment of the grinding machine 10 elucidated in connection with FIGS. 3 and 5. Nevertheless, FIG. 4 elucidates a conceivable cross section through the grinding machine 10.

In FIG. 5, further a coordinate system is shown for illustrative reasons, wherein an X-axis and a Z-axis are visible in the view plane of FIG. 5. A corresponding Y-axis (vertical axis) is basically arranged perpendicular to the view plane of FIG. 5, refer to FIG. 4. The X-axis may be for instance referred to as transverse axis and may designate a transverse direction. The Z-axis may be for instance referred to as longitudinal axis and may designate a longitudinal direction. Further, a so-called pivot axis is indicated in FIG. 5 by an arrow designated by C, wherein the pivot axis may be also referred to as C-axis. The C-axis indicates rotational movements and/or swiveling movements about the Z-axis. Similarly, rotational or swiveling movements about the X-axis may be referred to as A-axis and rotational or swiveling movements about the Y-axis may be referred to as B-axis, refer in this respect also to the coordinate system shown in FIG. 1. The coordinate system shown in FIGS. 4 and 5 may be transferred to any of the configurations in accordance with FIG. 3 and FIGS. 6 to 15.

Again referring to FIGS. 3, 4 and 5, a basic structure of the configuration of the grinding machine 10 is described in more detail. Al already basically described herein before, the grinding machine 10 is provided with a grinding spindle stock 24 and a regulator spindle stock 26. The grinding spindle stock 24 supports a grinding spindle 28 to which a grinding wheel 32 may be attached. The regulator spindle stock 26 supports a regulator spindle 30 to which a regulator wheel 34 can be attached. The grinding wheel 32 and the regulator wheel 34 both may act on a to-be-machined workpiece 50 which is received at a workpiece mount 46.

For acting on the workpiece 50 it is required that the grinding spindle 28 and the regulator spindle 30 may approach the workpiece 50 in an in-feed movement and/or may be displaced in a feed movement relative to the workpiece mount 46 in a controlled and defined fashion.

For this purpose, the grinding machine 10 comprises a carriage arrangement, for instance a compound slide (cross slide) arrangement involving a plurality of carriages 54, 56, 58. At the machine bed 12 of the grinding machine 10, a base carriage 54 is received which, in turn, supports a primary carriage 56 and a secondary carriage 58 which are arranged thereon. The base carriage 54 cooperates with the machine bed 12 so as to define a first movement axis 60 in this way. The first movement axis 60 may be for instance arranged as a so-called longitudinal axis (Z-movement axis). Further, the base carriage 54 may cooperate with the primary carriage 56 so as to define a further movement axis. By way of example, this may be the third movement axis 64. The third movement axis 64 may be referred to as so-called transverse axis (X-movement axis). Finally, the base carriage 54 may cooperate for instance with the secondary carriage 58 so as to define a second movement axis 62. The second movement axis 62 may for instance refer to as transverse axis (X-movement axis). For further discriminative purposes, it may be envisaged to designate the second movement axis 62 as X1-axis and the third movement axis 64 as X2-axis.

According to the embodiment elucidated with reference to FIG. 3 and FIG. 5, for instance the regulator spindle 30 is arranged at the primary carriage 56. Further, the grinding spindle 28 is arranged at the secondary carriage 58, for instance. It goes without saying that the assignment may also take place in reverse order. Insofar as primary elements, secondary elements as well as first, second, third elements and such like are mentioned within the scope of this disclosure, this shall be, above all, merely serve for discriminative purposes and generally shall not indicate a qualitative emphasis. The movement axes 60, 62, 64 are elucidated in FIG. 5 by respective block arrows. It goes without saying that, at least in some embodiments, the second movement axis 62 and the third movement axis 64 may be oriented in a fashion parallel to one another. Further, the first movement axis 60 may be, at least in some embodiments, oriented in a fashion perpendicular to the second movement axis 62 and/or the third movement axis 64.

Between the machine bed 12 and the base carriage 54, a longitudinal guide or longitudinal guide unit 68 is formed which comprises at least one longitudinal guide element 70. The at least one longitudinal guide element 70 may be for instance arranged as a guide track or such like. In an exemplary embodiment, the longitudinal guide element 70 may be fixedly attached to the machine bed 12. Accordingly, a mating contour may be provided at the primary carriage 56, for instance a slide or such like, so as to move the primary carriage 56 in the Z-direction along the guide element 70.

For implementing the second movement axis 62 and/or the third movement axis 64, further a primary guide unit 72 and/or a secondary guide unit 74 may be arranged. The den guide units 72, 74 may be for instance arranged as a transverse guide unit 76. The transverse guide unit 76 may comprise at least one guide element 78 which is, for instance, arranged as a guide track which is fixedly attached to the base carriage 54. The primary guide unit 72 may be interposed between the base carriage 54 and the primary carriage 56. The secondary guide unit 74 may be interposed between the base carriage 54 and the secondary carriage 58. Accordingly, both the primary carriage 56 and also the secondary carriage 58 may comprise slide contours and/or slides so as to ensure a displacement movement of the primary carriage 56 and the secondary carriage 58 in the X-direction relative to the base carriage 54.

Accordingly, each of the base carriage 54, the primary carriage 56 and also the secondary carriage 58 may be arranged in a movable fashion. For this purpose, the grinding machine 10 may comprise a first displacement drive 82, a second displacement drive 84 and a third displacement drive 86. In an exemplary embodiment, the displacement drives 82, 84, 86 are arranged as integrated displacement drives. This may for instance involve that respective motors 88, 90, 92 of the displacement drives 82, 84, 86 are fixedly assigned to a to-be-displaced carriage 54, 56, 58. In other words, in accordance with at least some embodiments it may be preferred that one or each of the motors 88, 90, 92 is received at the machine bed 12 in a fashion fixedly attached at the machine bed 12. In this way, effortful installations for force transmission may be avoided.

The first displacement drive 82 is assigned to the base carriage 54 and provided with the first motor 88. The second displacement drive 84 is assigned to the primary carriage 56 and assigned with the second motor. The third displacement drive 86 is assigned to the secondary carriage 58 and provided with the third motor 92. In accordance with a preferred embodiment, at least one of the displacement drives 82, 84, 86 comprises a threaded spindle and/or a threaded spindle gear 94, 96, 98. By way of example, the first displacement drive 82 may be coupled with a first threaded spindle 94. This may involve a threaded spindle 94 which is fixedly attached to the machine bed 12. Accordingly, the first motor 88 of the first displacement drive 82 may for instance act on a spindle nut to set the spindle nut in rotations so as to displace the base carriage 54 in a controlled fashion in the Z-direction.

In accordance with at least some embodiments it is preferred that the second displacement drive 84 and the third displacement drive 86 are coupled with a common threaded spindle 96. The threaded spindle 96 may be for instance fixedly attached to the base carriage 54. Accordingly, the second motor 90 may act on a nut so as to displace the primary carriage 56 in the X-direction. Similarly, the third motor 92 may act on a nut so as to displace the secondary carriage 58 in the X-direction. Even though the second displacement drive 84 and the third displacement drive 86 use the same second threaded spindle 96, the primary carriage 56 and the secondary carriage 58 may be moved with respect to one another. Since the primary carriage 56 and the secondary carriage 58 at least sectionally share the same transverse guide unit 76 and at least sectionally the same threaded spindle or screw spindle 96, fundamental design simplifications may be achieved.

Overall, both the grinding spindle 28 and also the regulator spindle 30 may be moved in a plane which is defined by the Z-axis and the X-axis. A movement in the Z-direction typically takes place for the grinding spindle 28 and the regulator spindle 30 in a synchronous fashion since both are received at the base carriage 54.

In several embodiments of the present disclosure it is generally preferred that the grinding machine 10 does not comprise a B-axis for the grinding spindle 28 and/or the regulator spindle 30. A B-axis is regularly arranged as a pivot axis which enables swiveling movements about the Y-axis (refer also to FIG. 4). Such axes may be implemented only with relatively huge structural effort. This increases the installation space, on the one hand and the costs, on the other hand.

According to the present disclosure, it is proposed to qualify the grinding machine 10 in other ways for machining non-cylindrical rotationally symmetric workpieces. This may be for instance the case when at least one of the grinding wheel 32 and the regulator wheel 34 may be adapted to the to-be-machined contour of the workpiece 50. This may be for instance effected by at least one dressing unit 102, 104. The dressing unit 102 may be assigned to the grinding spindle 28. The dressing unit 104 may be assigned to the regulator spindle 30. The dressing unit 102 is provided with a dressing tool 106 which is arranged to cooperate with the grinding wheel 32. The dressing unit 104 is provided with a dressing tool 108 which is arranged to cooperate with the regulator wheel 34.

By way of example, the dressing unit 102 may comprise an integrated tool spindle and a respective drive for driving a dressing tool 106 which is for instance arranged in a disk-like fashion so as to machine the grinding wheel 32. By way of example, the dressing unit 104 may comprise a fixed dressing tool 108 which is for instance arranged in a fashion similar to a lathe tool (turning tool). It goes without saying that basically also modified embodiments of the dressing units 102, 104 may be envisaged. In an exemplary embodiment, the dressing units 102, 104 are coupled with the machine bed 12 in a fashion fixedly attached thereto. This may be achieved for instance via a support 112 (or support bracket), refer also to FIG. 4.

The support 112 may be fixedly coupled the machine bed 12. The support 112 may be for instance arranged for supporting the workpiece mount 46 for receiving the workpiece 50, and for supporting at least one of the first dressing unit 102 or the second dressing unit 104. In an exemplary embodiment, at least one of the dressing units 102, 104 may be arranged adjacent to the workpiece mount 46. It goes without saying that also embodiments may be envisaged therein at least one of the dressing units 102, 104 is arranged at the machine bed 12 in a fashion considerably spaced away from the workpiece mount 46. Further, a cover is indicated in FIG. 4 in a schematic greatly simplified fashion which may involve fixedly mounted parts 114 and movable parts 116. The cover 114, 116 may be for instance arranged as telescopic (metal) sheets, bellows, and similar covers.

A relative movement between the grinding wheel 32 and the first dressing unit 102 as well as between the regulator wheel 34 and the second dressing unit 104 may be effected by the displacement drives 82, 84, 86 of the grinding machine 10. Consequently, it is preferred that the dressing units 102, 104 do not comprise separate displacement drives. This may lead to further structural simplifications. In other words, the capability of the grinding spindle 28 and the regulator spindle 30 to be displaced in a plane defined by the axes Z and X may be also utilized to machine the grinding wheel 32 and/or the regulator wheel 34 in a defined fashion by cooperating with the dressing units 102, 104 so as to enable machining of non-cylindrical. This may for instance involve at least sectionally conical, stepped and/or spherical workpieces 50. Further, also machining of workpieces 50 may be envisaged that are provided with plunges, shoulders and/or similar design elements.

FIG. 4 illustrates in a greatly simplified fashion by means of a cross-sectional view a "layered" arrangement of the grinding machine 10. As basically already described herein before, accordingly the base carriage 54 may be arranged at the machine bed 12 in a longitudinally movable fashion (refer to a first movement axis 60 indicated by a double arrow in FIG. 4). At the base carriage 54, the primary carriage 56 and the secondary carriage 58 may be arranged as already indicated herein before. The cross-sectional view of FIG. 4 further shows that for instance the grinding spindle stock 24 may be arranged at the secondary carriage 58. The grinding spindle stock 24 supports the grinding spindle 28 including the grinding wheel 32. The grinding wheel 32 may be brought into engagement with the workpiece 50 which may be supported at the workpiece mount 46. The workpiece mount 46 may be jointly arranged with at least one dressing unit 102 at a fixed support 112 in a stationary fashion.

FIG. 5 shows a grinding machine 10 which basically corresponds to the grinding machine 10 of FIG. 3. However, in FIG. 5, the base carriage 54, the primary carriage 56 and the secondary carriage 58 are displaced in such a way that the grinding wheel 32 and the regulator wheel 34 may be brought into engagement with the dressing units 102, 104 assigned thereto. It goes without saying that such dressing procedures do not necessarily have to take place simultaneously for the grinding wheel 32 and the regulator wheel 34. Further, in FIG. 5 is indicated a conceivable stepped contour of the grinding wheel 32 by dashed lines. Accordingly, stepped sections, conical sections and/or curved sections may be generated at the grinding wheel 32 so as to represent a desired geometry of the to-be-machined workpiece 50. Also the regulator wheel 34 may be dressed in a similar fashion, even though it is not necessarily required for the regulator wheel 34 to reproduce the desired geometry of the workpiece 50 in an exact fashion. The dressing units 102, 104 may be used to produce these non-cylindrical and/or stepped rotationally symmetric contours.

FIG. 5 further illustrates a conceivable access direction 118 in which the grinding machine 10 may be accessible for an operator. Generally, the grinding machine 10 comprises, at the side thereof which faces the access direction 118, at least one door, gate, hatch, hood or similar elements which enable a defined access.

The primary carriage 56 and the secondary carriage 58 may, at least sectionally, engage one another so as to enable a further reduction of the required installation space. By way of example, FIG. 5 illustrates that the primary carriage 56 comprises a plurality of guide sections 122, for instance in total four guide sections 120, 122, two of which, respectively, are assigned to a guide element 78 and arranged at opposite ends of the primary carriage 56. Accordingly, between two guide sections 122 that are spaced away from one another, a recess 120 may be formed which reveals at least a section of the transverse guide unit 76 and/or a corresponding guide element 78. Accordingly, the secondary carriage 58 may comprise respective guide sections 124 which cooperate with the at least one guide element 78 in the area of the recess 120. In other words, the primary carriage 56 and the secondary carriage 58 may be arranged in an "intertwined" or "interdigitated" fashion.

Figure 6:
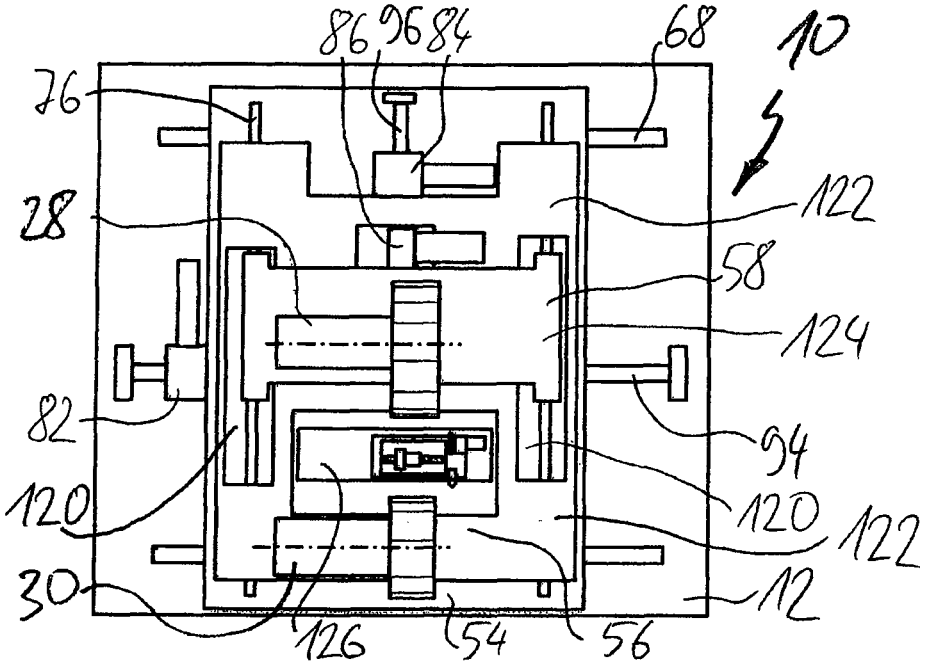
FIG. 6 is a greatly simplified schematic top view of a further embodiment of a centerless grinding machine in a first state.
Figure 7:
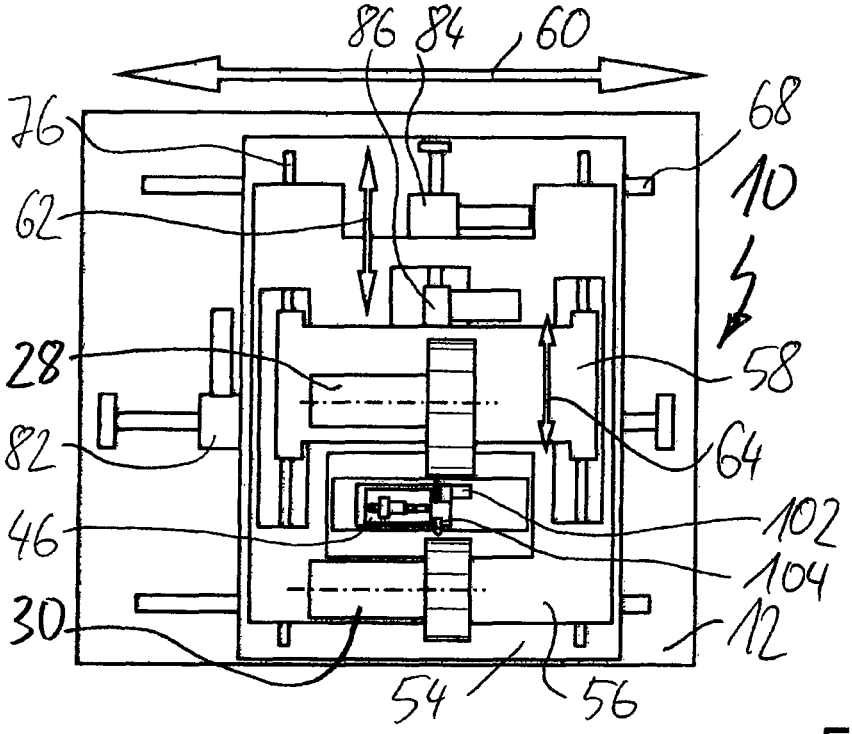
FIG. 7 is a further greatly simplified schematic view of the grinding machine of FIG. 6 in a further state.

With reference to FIGS. 6 and 7, a modified embodiment of a grinding machine 10 is elucidated. FIGS. 6 and 7 may basically relate to the same embodiment, wherein main components of the grinding machine 10, for instance a base carriage 54, a primary carriage 56 and/or a secondary carriage 58 are shown in FIGS. 6 and 7 in different displacement positions.

The configuration in accordance with FIGS. 6 and 7 basically deviates from the configuration in accordance with FIGS. 3 and 5 in that, on the one hand, the workpiece mount 46 is jointly arranged with the first dressing unit 102 and the second dressing unit 104 in a central portion at the machine bed 12. This further involves that at least at the base carriage 54, a clearance or recess 126 has to be provided to enable an access to the workpiece mount 46 and the dressing units 102, 104. The recess 126 may also extend through the primary carriage 56. Further, the configuration in accordance with FIGS. 6 and 7 differs from the configuration in accordance with FIGS. 3 and 5 in that the recesses 120 in the area of the primary carriage 56 are arranged as "closed" recesses 120, i.e. form a closed profile at the primary carriage 56. This may further increase the stiffness and the guide accuracy.

Figure 8:
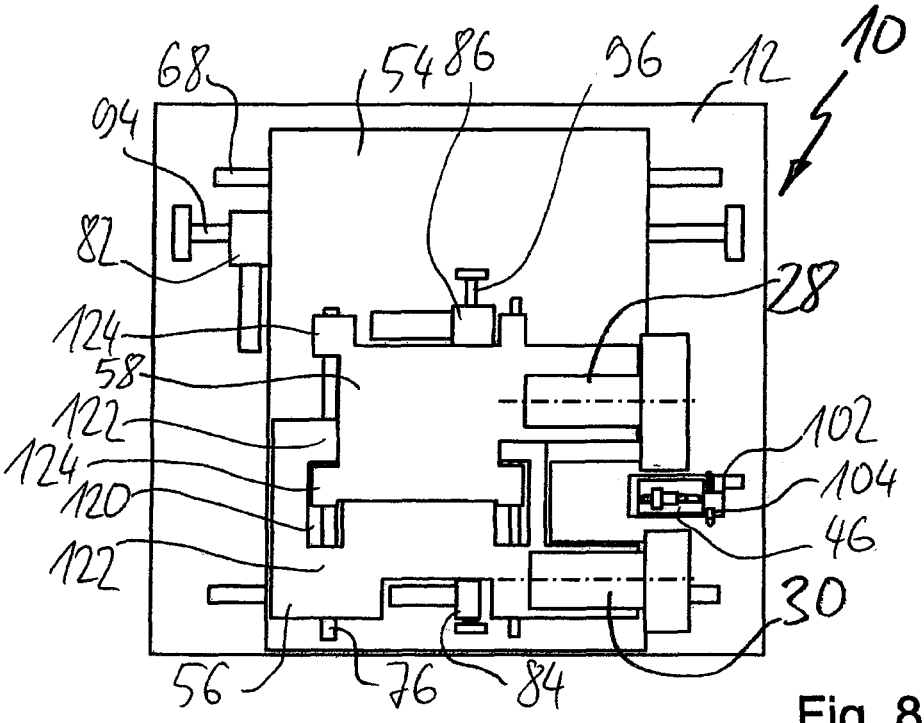
FIG. 8 is a greatly simplified schematic top view of a further embodiment of a centerless grinding machine.

FIG. 8 illustrates a further exemplary embodiment of a grinding machine 10 which is basically largely similar to the configurations of FIGS. 3 to 7. The workpiece mount 46 and the dressing units 102, 104 are arranged and/or fixedly attached at the machine bed 12 in an end region thereof. In basically already described fashion, the base carriage 54, the primary carriage 56 and the secondary carriage 58 are arranged at the machine bed 12, wherein the grinding spindle 28 is arranged at the secondary carriage 58 and wherein the regulator spindle 30 is arranged at the primary carriage 56. The primary carriage 56 is provided with a displacement drive 84. The secondary carriage 58 is provided with a displacement drive 86. The displacement drives 84, 86 share a common screw spindle or threaded spindle 96. At least some of the guide sections 124 of the secondary carriage 58 are arranged in recesses 120 which are formed at the primary carriage 56.

Figure 9:
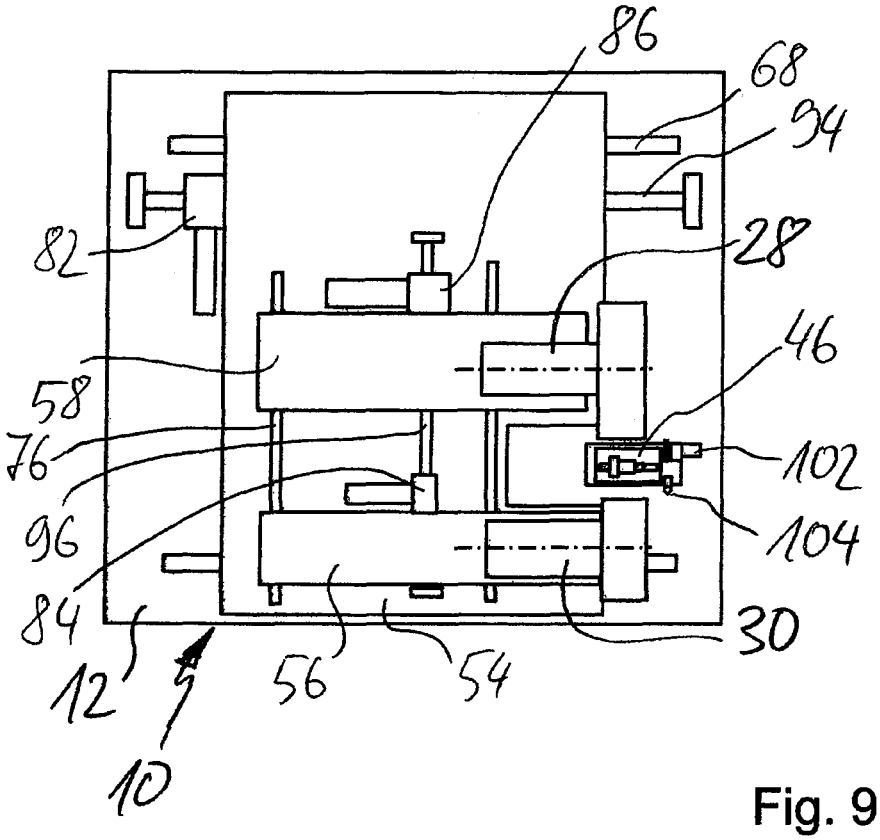
FIG. 9 is a greatly simplified schematic top view of a further embodiment of a centerless grinding machine.

FIG. 9 illustrates a further exemplary embodiment of a grinding machine 10 which is basically similar to the configuration in accordance with FIG. 8. The grinding machine 10 of FIG. 9, however, basically differs from the configuration of FIG. 8 in that the primary carriage 56 and the secondary carriage 58 are not arranged in an "intertwined" fashion or engaging one another and/or engaging above one another, so as to cooperate with the transverse guide unit 76. In other words, the primary carriage 56 and the secondary carriage 58 are arranged at the transverse guide unit 76 in a fashion spaced away from one another. However, the displacement drives 84, 86 of the primary carriage 56 and the secondary carriage 58 may share a common screw spindle or threaded spindle 76 so as to move the primary carriage 56 and the secondary carriage 58 independently from one another in the transverse direction (X-direction).

Figure 10:
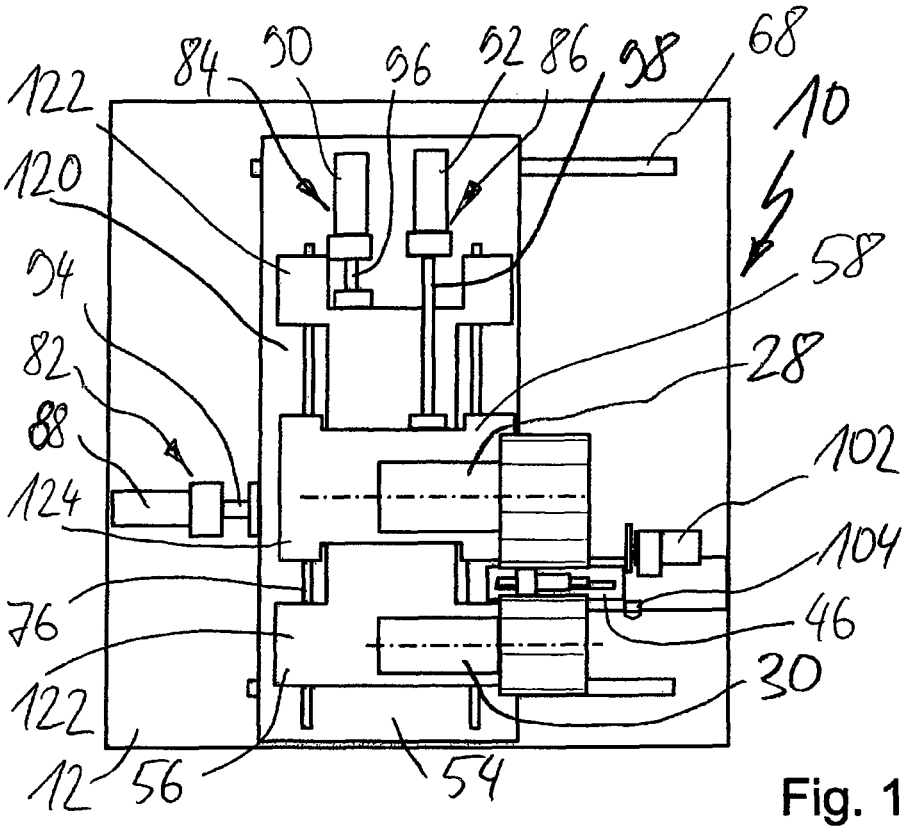
FIG. 10 is a greatly simplified schematic top view of a further embodiment of a centerless grinding machine.

FIG. 10 illustrates a further alternative embodiment of a grinding machine 10. As already explained, the grinding machine 10 comprises a machine bed 12 at which a base carriage 54, a primary carriage 56 and a secondary carriage 58 are arranged. Further, a longitudinal guide unit 68 and a transverse guide unit 76 are provided, as already explained herein before. The configuration in accordance with FIG. 10 differs from the configuration in accordance with FIGS. 3 to 9 for instance in that the motors 88, 90, 92 of the displacement drives 82, 84, 86 which are coupled with the base carriage 54, the primary carriage 56 and the secondary carriage 58, are, as such, not integrated in the to-be-moved component. In other words, for instance the motor 88 of the first displacement drive 82 is fixedly attached to the machine bed 12. The motor 90 of the second displacement drive 84 is fixedly attached to the base carriage 54. Similarly, the motor 92 of the third displacement drive 86 is fixedly attached to the base carriage 54. By way of example, each of the motors 88, 90, 92 may be coupled with screw spindles or threaded spindles 94, 96, 98 so as to move the base carriage 54, the primary carriage 56 and/or the secondary carriage 58 in the desired fashion. The embodiment illustrated with reference to FIG. 10 thus illustrates a variant of the grinding machine 10 wherein the second displacement drive 84 which cooperates with the primary carriage 56 and the third displacement drive 86 which cooperates with the secondary carriage 58 are respectively coupled with an own, distinct screw spindle 96, 98.

Figure 11:
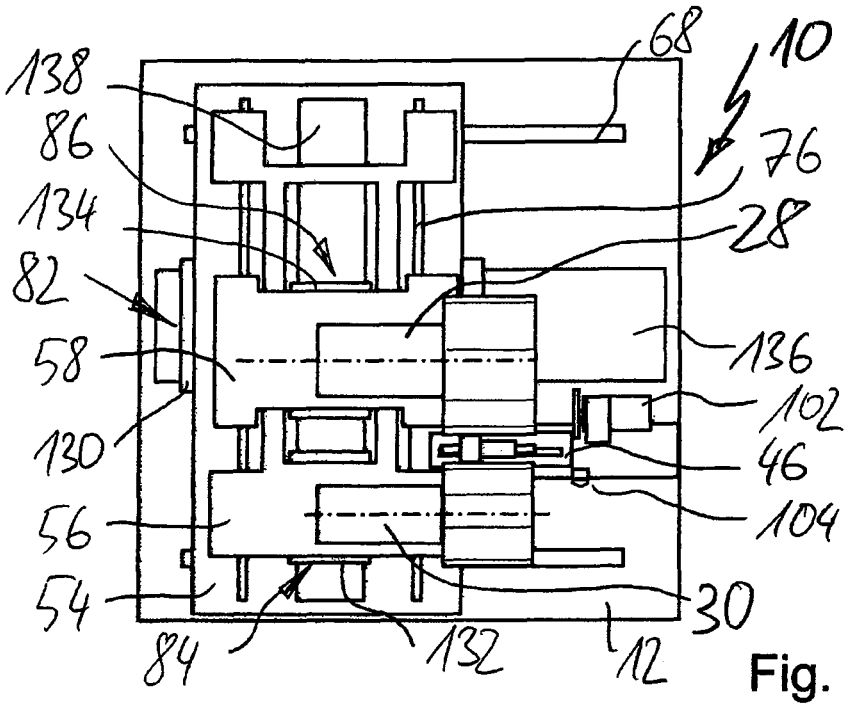
FIG. 11 is a greatly simplified schematic top view of a further embodiment of a centerless grinding machine.

A further exemplary embodiment of a grinding machine 10 is elucidated with reference to FIG. 11. The configuration of the grinding machine 10 in accordance with FIG. 11 is basically similar to the embodiments already described herein before. A modification is, however, present with respect to the detailed arrangement of the displacement drives 82, 84, and 86. At least one of the displacement drives 82, 84, 86 may be namely arranged as a so-called linear motor 130, 132, 134 and/or provided with such a linear motor 130, 132, 134. Generally, a linear motor is a gear-less motor which is arranged to directly generate a linear movement. In other words, a linear motor may be understood as "unwinding" of a (rotationally effective) electromotor. By way of example, the displacement drive 82 which is assigned to the base carriage 54 may comprise a first linear motor 130 which cooperates with a first stator 136. The stator 136 may basically extend in a fashion parallel to the longitudinal guide unit 68. In accordance with a further alternative embodiment, it may be also envisaged to combine the stator 136 and the longitudinal guide unit 68 with one another. As used herein, the movable components of the linear motors may be referred to as armatures which are movably arranged at a linear stator. In a rotary motor, the corresponding component is a rotor that cooperates with a stator.

The second displacement drive 84 which is assigned to the primary carriage 56 may for instance comprise a second linear motor 132 which is covered with a stator 138. The third displacement drive 86 which is assigned to the secondary carriage 58 may for instance comprise a third linear motor 134 which is coupled with the second stator 138. As basically already described herein before, the second linear motor 132 and the third linear motor 134 may thus share the same stator 138. The second stator 138 may basically extend in a fashion parallel to the transverse guide unit 76. According to further alternative embodiments, the transverse guide unit 76 and the second stator 138 may be coupled with one another and/or integrated into one another.

In accordance with the embodiments of the grinding machine 10 illustrated with reference to FIGS. 3 to 11, each of the three required movement axes 60, 62, 64 is arranged as a linear axes. However, it may be basically also envisaged to configure one or two of the movement axes 60, 62, 64 as a pivot axis, for instance as a so-called C-axis which enables a rotational movement or swiveling movement about the longitudinal axis or Z-axis. Hereinafter, embodiments of that kind will be elucidated with reference to FIG. 12 and to FIG. 13.

Figure 12:
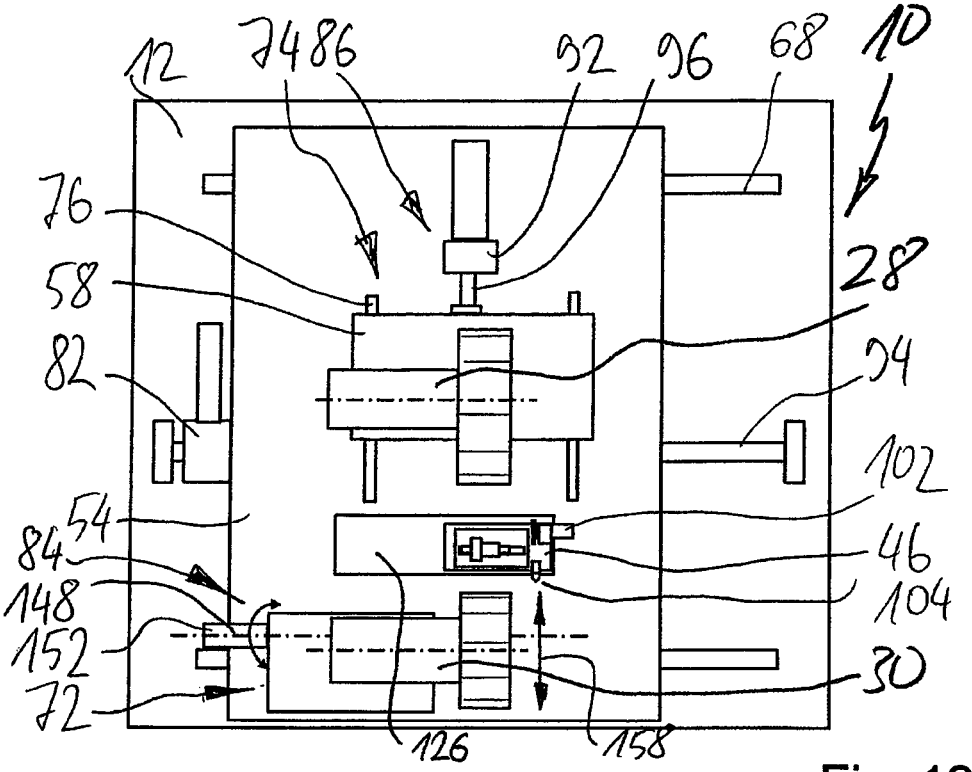
FIG. 12 is a greatly simplified schematic top view of a further embodiment of a centerless grinding machine.

FIG. 12 elucidates an embodiment of a grinding machine 10, wherein a base carriage 54 is provided as basically already described herein before which is movable in the longitudinal direction by means of a longitudinal guide unit 68. Further, a secondary carriage 58 for the grinding spindle 28, wherein the secondary carriage 58 is coupled with a transverse guide unit 76 so as to enable a (linear) movement in the transverse direction (X-direction). To this end, a displacement drive 86 is provided which comprises a motor 92 and which is coupled with a threaded spindle or screw spindle 96.

However, for implementing a respective in-feed movement in the transverse direction or X-direction for the regulator spindle 30, the grinding machine 10 in accordance with FIG. 12 is provided with a displacement drive 84 which is arranged as a pivot drive. The displacement drive 84 comprises a swivel motor 152 which enables a swiveling movement about a pivot axis 148 which is basically oriented in a fashion parallel to the Z-axis, refer also to FIG. 5. The regulator spindle 30 is arranged at the pivot axis 148 in an eccentric fashion. Accordingly, a swiveling movement about the pivot axis 148 may effect a resulting in-feed movement which is indicated in FIG. 12 by a double arrow designated by 158. It goes without saying that the swiveling movement which is effected by the pivot drive, on the one hand, indeed comprises a linear component which is active in the transverse direction or X-direction. However, the swiveling movement shall be understood, however, as a combined movement which also comprises movement components which are differently oriented. However, via a respective machine control a desired in-feed movement may be implemented without further ado.

Figure 13:
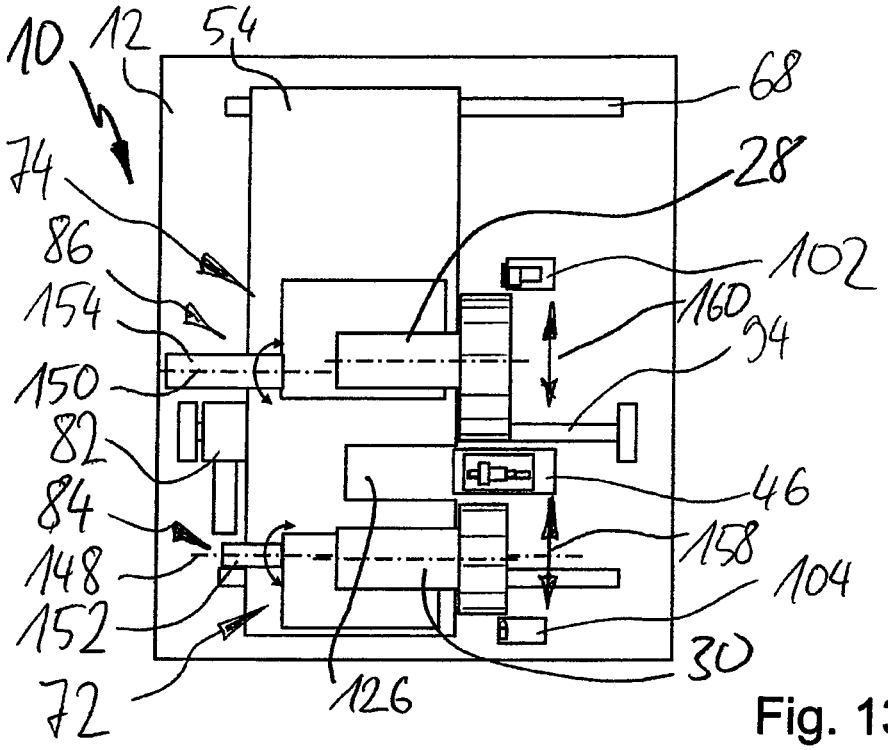
FIG. 13 is a greatly simplified schematic top view of a further embodiment of a centerless grinding machine.

A further alternative embodiment of a grinding machine 10 which is elucidated with reference to FIG. 13 deviates from the embodiments already described herein before primarily in that neither a (linearly movable) primary carriage 56 nor a (linearly movable) secondary carriage 58 is provided. The respective displacement drives 84, 86 are implemented as pivot drives at the grinding machine 10 in accordance with FIG. 13. The displacement drive 84 is basically arranged in accordance with the displacement drive 84 which already has been elucidated with reference to FIG. 12 and which is arranged as a pivot drive. Accordingly, the displacement drive 84 comprises a pivot axis 148 which is coupled with a swivel motor 152. Hence, the regulator spindle 30 may be pivoted about the pivot axis 148 so as to generate a resulting in-feed movement 158.

Similarly, also the displacement drive 86 for the grinding spindle 28 may basically comprise a pivot axis 150 which is coupled with a swivel motor 154. The swivel motor 154 may be arranged to pivot the grinding spindle 28 about the pivot axis 150. In this connection, the grinding spindle 28 is, in an exemplary embodiment, arranged in an eccentric fashion with respect to the pivot axis 150. Accordingly, a swiveling of the grinding spindle about the pivot axis 150 effects a resulting in-feed movement of the grinding spindle which is elucidated in FIG. 13 by a double arrow designated by 160. It is further illustrated in FIG. 13, by way of example, that at least one of the dressing units 102, 104 may be arranged at the machine bed 12 in a fashion spaced away from the workpiece mount. It goes without saying that, in respect of the arrangement of the dressing units 102, 104, this embodiment may be also transferred to any of the afore-mentioned embodiments.

Figure 14:
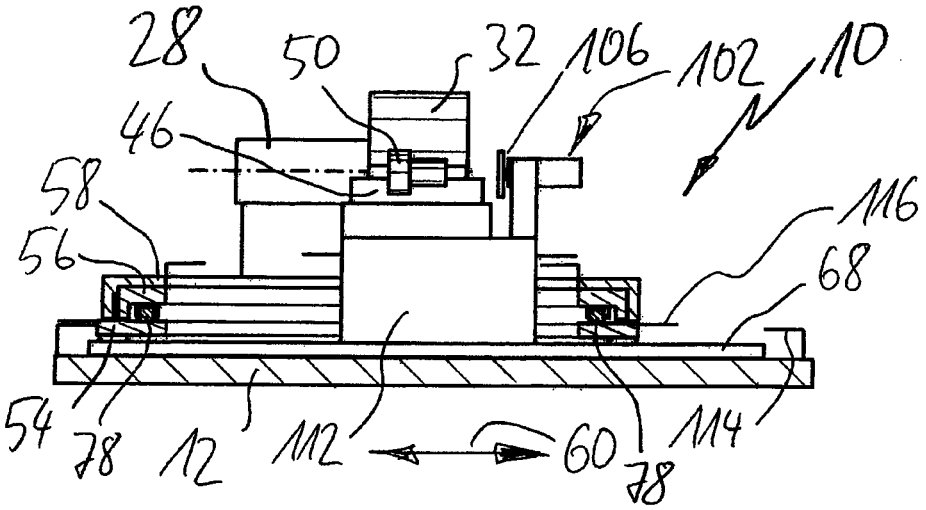
FIG. 14 is a greatly simplified lateral cross-sectional view of a further embodiment of a centerless grinding machine.
Figure 15:
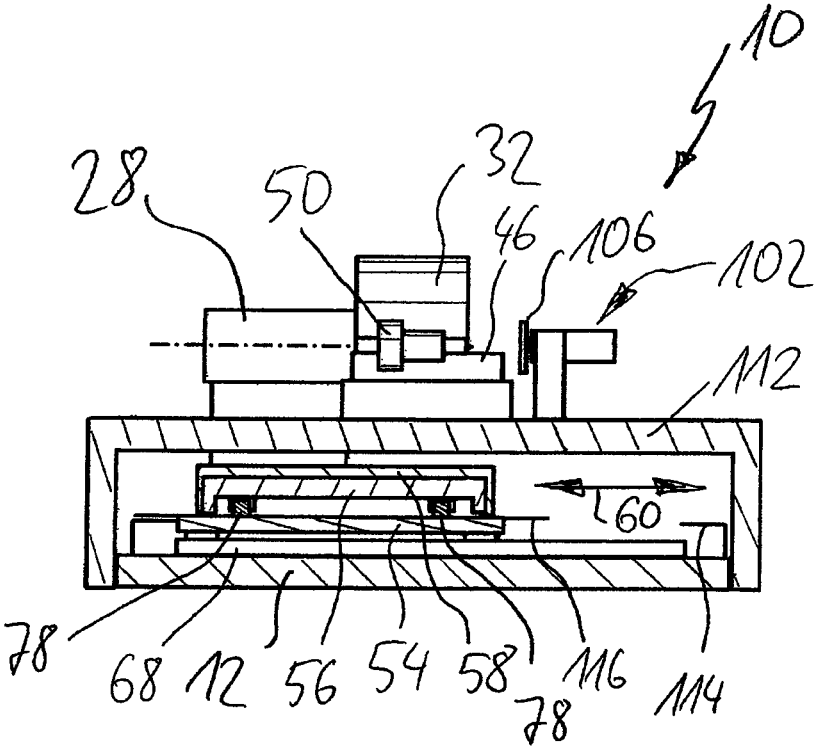
FIG. 15 is a greatly simplified lateral cross-sectional view of yet another embodiment of a centerless grinding machine.

FIGS. 14 and 15 illustrate in a greatly simplified schematic form lateral cross-sections through different embodiments of grinding machines 10. For comparative purposes, reference is made to FIG. 4 in this connection. The cross-sections illustrated with reference to FIG. 14 and to FIG. 15 may be basically positioned in a similar fashion. Even though the cross-sections which are elucidated with reference to FIG. 14 and FIG. 15 are not based on the grinding machines as illustrated in FIG. 3 and FIG. 5, at least for orientation purposes, reference is made to the section line IV-IV in FIG. 3 so as to illustrate a conceivable arrangement of the respective cross-section.

FIG. 4 illustrates an embodiment of the grinding machine 10, wherein the workpiece mount 46 and the at least one dressing unit 102, 104 are received at a support which is laterally arranged at the machine bed. Accordingly, a C-shaped support structure for the workpiece mount 46 and for the at least one dressing unit 102, 104 may result.

According to FIG. 14, a modification of the grinding machine 10 may involve that the workpiece mount 46 and/or the at least one dressing unit 102, 104 are fixedly attached to the machine bed 12 at a central (mid) position thereof, and may comprises a support 112 which extends through a recess 126 which is formed at least in the base carriage 54 and, as the case may be, also in the primary carriage 56 and, as the case may be, even in the secondary carriage 58. Accordingly, the embodiment according to FIG. 14 may correspond to the top views as illustrated with reference to FIGS. 6 and 7, for instance.

FIG. 15 illustrates a further modified embodiment of a grinding machine 10, wherein the support is arranged in a gantry (portal) fashion and fixedly attached to the machine bed 12. At the gantry support 112 the at least one workpiece mount 46 and/or at least one dressing unit 102, 104 may be arranged.

It goes without saying that the embodiments and configurations described herein before shall be respectively construed as exemplary examples of the basic concept of the present disclosure. Accordingly, it further goes without saying that detailed aspects of one embodiment may be combined with detailed aspects of a further embodiment without further ado, and without departing from the spirit and scope of the present disclosure.

What is claimed is:

1. A grinding machine, comprising:

a machine bed, a grinding spindle that is arranged to be coupled with a spindle drive and for receiving a grinding wheel, a regulator spindle that is arranged to be coupled with a spindle drive and for receiving a regulator wheel, a workpiece mount for receiving a to-be-machined workpiece between the grinding spindle and the regulator spindle, a longitudinal guide formed at the machine bed, a base carriage movably received at the longitudinal guide, wherein the machine bed and the base carriage define a first movement axis, wherein the grinding spindle is coupled with the base carriage and assigned to a second movement axis, wherein the regulator spindle is coupled with the base carriage and assigned to a third movement axis, wherein the grinding spindle and the regulator spindle are movably coupled with the machine bed, and wherein the grinding spindle and the regulator spindle are arranged to be moved with respect to one another and to mutually approach the workpiece mount in a respective in-feed movement.

2. The grinding machine as claimed in claim 1, wherein the grinding machine is arranged as a centerless grinding machine, and wherein the wherein the grinding spindle and the regulator spindle form a spindle set of the centerless grinding machine, the spindle set comprising a first spindle and a second spindle, one of which being arranged as the grinding spindle and the other one being arranged as the regulator spindle.

3. The grinding machine as claimed in claim 2, wherein the first spindle of the spindle set is coupled with the base carriage via a primary guide unit that defines the second movement axis, and wherein the second spindle of the spindle set is coupled with the base carriage via a secondary guide unit that defines the third movement axis.

4. The grinding machine as claimed in claim 3, wherein at least one of the primary guide unit and the secondary guide unit is arranged as one of a swivel guide and a linear guide.

5. The grinding machine as claimed in claim 3, wherein the primary guide unit is directly arranged at the base carriage, and wherein the secondary guide unit is directly arranged at one of the base carriage and the primary guide unit.

6. The grinding machine as claimed in claim 3, wherein a movement of the primary guide unit relative to the base carriage causes a corresponding movement of the secondary guide unit relative to the base carriage.

7. The grinding machine as claimed in claim 3, wherein the primary guide unit and the secondary guide unit are movable relative to the base carriage in a fashion independent of one another.

8. The grinding machine as claimed in claim 1, further comprising a transverse guide which is formed at the base carriage, a primary carriage and a secondary carriage, wherein each of the primary carriage and the secondary carriage is received at the transverse guide, wherein a first spindle of the spindle set is assigned to the primary carriage, and wherein a second spindle of the spindle set is assigned to the secondary carriage.

9. The grinding machine as claimed in claim 1, wherein at least one of the grinding spindle and the regulator spindle is arranged at the base carriage in a pivotable fashion, and wherein the at least one spindle is further arranged to approach the workpiece mount in an in-feed movement through a swiveling movement about a pivot axis.

10. The grinding machine as claimed in claim 1, wherein a first spindle of the grinding spindle and the regulator spindle is arranged at the base carriage in a pivotable fashion, wherein the first spindle is further arranged to approach the workpiece mount in an in-feed movement through a swiveling movement about a pivot axis, and wherein a second spindle of the grinding spindle and the regulator spindle is arranged at a transverse guide in a fashion displaceable along the transverse guide, wherein the second spindle is further arranged to approach the workpiece mount in an in-feed movement.

11. The grinding machine as claimed claim 1, wherein at least one of the base carriage, the primary guide unit and the secondary guide unit comprises an integrated displacement drive.

12. The grinding machine as claimed in claim 11, wherein the at least one integrated displacement drive comprises a threaded spindle.

13. The grinding machine as claimed in claim 11, wherein the at least one integrated displacement drive is arranged as a direct drive.

14. The grinding machine as claimed in claim 13, wherein the direct drive is arranged as a linear motor, and wherein a plurality of linear armatures is provided that are coupled with the same stator.

15. The grinding machine as claimed in claim 1, wherein the workpiece mount is fixedly attached to the machine bed.

16. The grinding machine as claimed in claim 1, further comprising at least one dressing unit for receiving a dressing tool, wherein the at least one dressing unit is configured for machining at least one of the grinding wheel and the regulator wheel, and wherein the at least one dressing unit is fixedly attached to the machine bed.

17. The grinding machine as claimed in claim 16, wherein the at least one dressing unit is arranged adjacent to the workpiece mount.

18. A compact design centerless grinding machine, comprising:

a machine bed, a grinding spindle that is arranged to be coupled with a spindle drive and for receiving a grinding wheel, a regulator spindle that is arranged to be coupled with a spindle drive and for receiving a regulator wheel, a workpiece mount for receiving a to-be-machined workpiece between the grinding spindle and the regulator spindle, a single base carriage movably received at the machine bed and arranged for providing a common feed movement of the grinding spindle and the regulator spindle, a single longitudinal guide unit arranged between the machine bed and the base carriage, a single primary guide unit and a single secondary guide unit, and at least one dressing unit arranged for dressing at least one of the grinding wheel and the regulator wheel, wherein the primary guide unit and the secondary guide unit are received at the base carriage and comprise, at least sectionally, common guide elements, wherein the grinding spindle and the regulator spindle form a spindle set comprising a first spindle and a second spindle, wherein the primary guide unit is coupled with the first spindle of the spindle set for providing an in-feed movement thereof, wherein the secondary guide unit is coupled with the second spindle of the spindle set for providing an in-feed movement thereof, wherein the base carriage, the primary guide unit and the secondary guide unit are arranged to displace the first spindle and the second spindle with respect to the workpiece mount and with respect to the at least one dressing unit, wherein the grinding machine is arranged as a three-movement-axes grinding machine comprising a first movement axis, a second movement axis, and a third movement axis, wherein the machine bed and the base carriage define, along the longitudinal guide unit, the first movement axis, wherein the primary guide unit defines the second movement axis, and wherein the secondary guide unit defines the third movement axis.

19. The grinding machine as claimed in claim 18, wherein the workpiece mount is fixedly attached to the machine bed.

20. The grinding machine as claimed in claim 18, further comprising a first dressing unit for receiving a first dressing tool and a second dressing unit for receiving a second dressing tool, wherein the first dressing unit is configured for machining at least one of the grinding wheel and the regulator wheel, wherein the second dressing unit is configured for machining the other one of the grinding wheel and the regulator wheel, and wherein the first dressing unit and the second dressing unit are fixedly attached to the machine bed.

* * * * *